US009724802B2

(12) United States Patent
Sung

(10) Patent No.: US 9,724,802 B2
(45) Date of Patent: Aug. 8, 2017

(54) CMP PAD DRESSERS HAVING LEVELED TIPS AND ASSOCIATED METHODS

(71) Applicant: Chien-Min Sung, Tansui (TW)

(72) Inventor: Chien-Min Sung, Tansui (TW)

( * ) Notice: Subject to any disclaimer, the term of this patent is extended or adjusted under 35 U.S.C. 154(b) by 0 days.

(21) Appl. No.: 14/506,476

(22) Filed: Oct. 3, 2014

(65) Prior Publication Data

US 2015/0133036 A1 May 14, 2015

Related U.S. Application Data

(63) Continuation-in-part of application No. 13/802,112, filed on Mar. 13, 2013, now Pat. No. 9,138,862, which is a continuation-in-part of application No. 13/479,148, filed on May 23, 2012, now Pat. No. 8,974,270, application No. 14/506,476, which is a continuation-in-part of application No. 13/797,704, filed on Mar. 12, 2013, which is a continuation-in-part of application No. 12/726,786, filed on Mar. 18, 2010, now Pat. No. 8,622,787, which is a continuation-in-part of application No. 12/255,823, filed on Oct. 22, 2008, now Pat. No. 8,393,934, which is a continuation-in-part of application No. 12/168,110, filed on Jul. 5, 2008, now (Continued)

(51) Int. Cl.

| | |
|---|---|
| ***B24B 53/00*** | (2006.01) |
| ***B24B 53/017*** | (2012.01) |
| ***B24B 53/12*** | (2006.01) |
| ***B24D 3/00*** | (2006.01) |

(52) U.S. Cl.

CPC ..... *B24B 53/017* (2013.01); *B24B 53/12* (2013.01); *B24D 3/00* (2013.01)

(58) Field of Classification Search

CPC ..... B24B 53/07; B24B 53/017; B24B 53/12; B24B 37/04; B24B 37/042; B24B 57/02

USPC ..... 451/443, 444, 548, 56

See application file for complete search history.

(56) References Cited

U.S. PATENT DOCUMENTS

| | | |
|---|---|---|
| 187,593 A | 2/1877 | Brown et al. |
| 238,946 A | 3/1881 | McKitrick |

(Continued)

FOREIGN PATENT DOCUMENTS

| | | |
|---|---|---|
| CN | 1351922 | 6/2002 |
| CN | 1494984 | 5/2004 |

(Continued)

OTHER PUBLICATIONS

Colmonoy Technical Data Sheet; No. DSP-A; 1993.

(Continued)

*Primary Examiner* — George Nguyen

(74) *Attorney, Agent, or Firm* — Thorpe North & Western, LLP; David W. Osborne

(57) ABSTRACT

CMP pad dressers having leveled tips and associated methods are provided. In one aspect, for example, a CMP pad dresser can include a support substrate and a plurality of superabrasive particles secured to the support substrate with each superabrasive particle extending away from the support substrate to a protrusion distance, where a highest protruding tip of each of the plurality of superabrasive particles align along a designated profile with a tip variation of from about 5 microns to about 100 microns.

21 Claims, 1 Drawing Sheet

Related U.S. Application Data

Pat. No. 8,398,466, said application No. 12/726,786 is a continuation-in-part of application No. 11/560,817, filed on Nov. 16, 2006, now Pat. No. 7,762,872, which is a continuation-in-part of application No. 11/357,713, filed on Feb. 17, 2006, now abandoned, said application No. 11/560,817 is a continuation-in-part of application No. 11/223,786, filed on Sep. 9, 2005, now abandoned, said application No. 13/797,704 is a continuation-in-part of application No. 12/850,747, filed on Aug. 5, 2010, now Pat. No. 8,678,878, said application No. 13/797,704 is a continuation-in-part of application No. 13/034,213, filed on Feb. 24, 2011, now abandoned.

(60) Provisional application No. 61/489,074, filed on May 23, 2011, provisional application No. 60/976,198, filed on Sep. 28, 2007, provisional application No. 60/681,798, filed on May 16, 2005, provisional application No. 61/246,816, filed on Sep. 29, 2009, provisional application No. 61/333,162, filed on May 10, 2010.

(56) References Cited

U.S. PATENT DOCUMENTS 296,756 A 4/1884 Kirkpatrick
1,854,071 A 4/1932 Schacht
1,988,065 A 1/1935 Wooddell
2,027,087 A 1/1936 Buckner
2,027,307 A 1/1936 Schacht
2,033,991 A 3/1936 Melton
2,035,521 A 3/1936 Benner
2,075,354 A 3/1937 Monier
2,078,354 A 4/1937 Webster
RE20,660 E 2/1938 Schacht
2,152,392 A * 3/1939 Tone ..... B24D 11/00 451/511
2,184,348 A 12/1939 Kirchner
2,187,624 A 1/1940 Melton
2,194,253 A 3/1940 Benner
2,201,195 A * 5/1940 Melton ..... B24D 11/005 451/539
2,204,826 A * 6/1940 Schneider ..... B24D 7/00 451/539
2,268,663 A 1/1942 Kuzmick
2,281,558 A 5/1942 Cross
2,307,461 A 1/1943 Ogden
2,318,570 A 5/1943 Paul
2,334,572 A 11/1943 Melton
2,410,506 A * 11/1946 Kirchner ..... B24D 11/00 451/539
2,612,348 A 9/1952 Catallo
2,652,951 A 9/1953 Augustus
2,725,693 A 12/1955 Leigh
2,811,960 A 11/1957 Fessel
2,867,086 A 1/1959 Haley
2,876,086 A 3/1959 Raymond
2,947,608 A 8/1960 Hall
2,952,951 A 9/1960 Simpson
3,067,551 A 12/1962 Maginnis
3,121,981 A 2/1964 Hurst
3,127,715 A 4/1964 Christensen
3,146,560 A 9/1964 Hurst
3,276,852 A 10/1966 Lemelson
3,293,012 A 12/1966 Smiley
3,372,010 A 3/1968 Parsons
3,377,411 A 4/1968 Charvat
3,416,560 A 12/1968 Bruno
3,440,774 A 4/1969 Curn
3,593,382 A 7/1971 Miller
3,608,134 A 9/1971 Cook
3,625,666 A 12/1971 James
3,630,699 A 12/1971 Catlin
3,631,638 A 1/1972 Yoshikawa et al.
3,664,662 A 5/1972 Linz
3,706,650 A 12/1972 Eisner
3,743,489 A 7/1973 Wentorf, Jr. et al.
3,767,371 A 10/1973 Wentorf, Jr. et al.
3,787,273 A * 1/1974 Okrepkie ..... B24D 11/02 156/279
3,802,130 A 4/1974 Lindenbeck
3,819,814 A 6/1974 Pope
3,852,078 A 12/1974 Wakatsuki
3,894,673 A 7/1975 Lowder et al.
3,905,571 A 9/1975 Lombardo
3,982,358 A 9/1976 Fukuda
4,018,576 A 4/1977 Lowder et al.
4,028,576 A 6/1977 Wofsey
4,078,906 A 3/1978 Green
4,149,881 A 4/1979 D'Silva
4,151,154 A 4/1979 Berger
4,155,721 A 5/1979 Fletcher
4,182,628 A 1/1980 D'Silva
4,188,194 A 2/1980 Corrigan
4,201,601 A 5/1980 D'Silva
4,211,294 A 7/1980 Multakh
4,211,924 A 7/1980 Müller et al.
4,224,380 A 9/1980 Bovenkerk et al.
4,228,214 A 10/1980 Steigelman et al.
4,229,186 A 10/1980 Wilson
4,273,561 A 6/1981 Villalobos
4,287,168 A 9/1981 Wentorf, Jr. et al.
4,289,503 A 9/1981 Corrigan
4,341,532 A 7/1982 Oide
4,355,489 A 10/1982 Heyer et al.
4,405,411 A 9/1983 Inoue et al.
4,481,016 A 11/1984 Campbell et al.
4,525,179 A 6/1985 Gigl
4,547,257 A 10/1985 Iizuka et al.
4,551,195 A 11/1985 Iizuka et al.
4,565,034 A 1/1986 Sekiya
4,610,699 A 9/1986 Yazu et al.
4,617,181 A 10/1986 Yazu et al.
4,629,373 A 12/1986 Hall
4,632,817 A 12/1986 Yazu et al.
4,662,896 A 5/1987 Dennis
4,669,522 A 6/1987 Griffin
4,680,199 A 7/1987 Vontell et al.
4,712,552 A 12/1987 Pangburn
4,737,162 A 4/1988 Grazen
4,749,514 A 6/1988 Murakami et al.
4,770,907 A 9/1988 Kimura
4,776,861 A 10/1988 Frushour
4,780,274 A 10/1988 Barr
4,797,241 A 1/1989 Peterson et al.
4,828,582 A 5/1989 Frushour
4,849,602 A 7/1989 Gardner
4,863,573 A 9/1989 Moore et al.
4,866,888 A 9/1989 Murai et al.
4,883,500 A 11/1989 Deakins et al.
4,901,480 A * 2/1990 Dillon ..... B24B 13/01 407/118
4,908,046 A 3/1990 Wiand
4,916,869 A 4/1990 Oliver
4,923,490 A 5/1990 Johnson et al.
4,925,457 A 5/1990 deKok et al.
4,927,619 A 5/1990 Tsuji
4,943,488 A 7/1990 Sung et al.
4,945,686 A 8/1990 Wiand
4,949,511 A 8/1990 Endo et al.
4,954,139 A 9/1990 Cerutti
4,968,326 A 11/1990 Wiand
5,000,273 A 3/1991 Horton et al.
5,011,513 A 4/1991 Zador et al.
5,022,895 A 6/1991 Wiand
5,024,680 A 6/1991 Chen et al.
5,030,276 A 7/1991 Sung et al.
5,037,451 A 8/1991 Burnand et al.
5,043,120 A 8/1991 Corrigan
5,049,165 A 9/1991 Tselesin
5,092,082 A 3/1992 Padberg

(56) References Cited

U.S. PATENT DOCUMENTS 5,092,910 A 3/1992 deKok et al.
5,116,568 A 5/1992 Sung
5,131,924 A 7/1992 Wiand
5,133,782 A 7/1992 Wiand
5,137,543 A 8/1992 Heath et al.
5,151,107 A 9/1992 Cho et al.
5,164,247 A 11/1992 Solanki et al.
5,176,155 A 1/1993 Rudolph, Jr.
5,190,568 A 3/1993 Tselesin
5,194,070 A 3/1993 Sumiya et al.
5,194,071 A 3/1993 Corrigan et al.
5,195,403 A 3/1993 Sani et al.
5,195,404 A 3/1993 Notter et al.
5,197,249 A 3/1993 Wiand
5,203,881 A 4/1993 Wiand
5,232,320 A 8/1993 Tank et al.
5,243,790 A 9/1993 Gagne
5,246,884 A 9/1993 Jaso
5,247,765 A 9/1993 Quintana
5,248,317 A 9/1993 Tank
5,264,011 A 11/1993 Brown et al.
5,266,236 A 11/1993 Bovenkerk
5,271,547 A 12/1993 Carlson
5,273,730 A 12/1993 Yoshida et al.
5,295,402 A 3/1994 Bovenkerk
5,314,513 A 5/1994 Miller
5,328,548 A 7/1994 Tsuji et al.
5,364,423 A 11/1994 Bigelow et al.
5,374,293 A 12/1994 Takashita et al.
5,380,390 A 1/1995 Tselesin
5,443,032 A 8/1995 Vichr et al.
5,453,106 A 9/1995 Roberts
5,454,343 A 10/1995 Eun et al.
5,458,754 A 10/1995 Sathrum et al.
5,486,131 A 1/1996 Cesna et al.
5,492,771 A 2/1996 Lowder et al.
5,492,774 A 2/1996 Tateno
5,496,386 A 3/1996 Broberg et al.
5,500,248 A 3/1996 Iacovangelo et al.
5,505,272 A 4/1996 Clark
5,518,443 A 5/1996 Fisher
5,527,424 A 6/1996 Mullins
5,536,202 A 7/1996 Appel et al.
5,547,417 A 8/1996 Breivogel et al.
5,551,959 A 9/1996 Martin et al.
5,560,745 A 10/1996 Roberts
5,560,754 A 10/1996 Johnson et al.
5,609,286 A 3/1997 Anthon
5,620,489 A 4/1997 Tselesin
5,660,894 A 8/1997 Chen et al.
5,669,943 A 9/1997 Horton et al.
5,674,572 A 10/1997 Sarin et al.
5,725,421 A 3/1998 Goers et al.
5,746,931 A 5/1998 Graebner
RE35,812 E 6/1998 Oliver
5,772,756 A 6/1998 Davies et al.
5,776,214 A 7/1998 Wood
5,779,743 A 7/1998 Wood
5,791,975 A 8/1998 Cesna et al.
5,801,073 A 9/1998 Robbins et al.
5,816,891 A 10/1998 Woo
5,820,450 A 10/1998 Calhoun
5,833,519 A 11/1998 Moore
5,840,090 A 11/1998 Ho et al.
5,851,138 A 12/1998 Hempel, Jr.
5,855,314 A 1/1999 Shiue et al.
5,868,806 A 2/1999 Nishio et al.
5,885,137 A 3/1999 Ploessl
5,902,173 A 5/1999 Tanaka
5,916,011 A 6/1999 Kim et al.
5,919,084 A 7/1999 Powell et al.
5,921,856 A 7/1999 Zimmer
5,924,917 A 7/1999 Benedict et al.
5,961,373 A 10/1999 Lai
5,975,988 A 11/1999 Christianson
5,976,001 A 11/1999 Powell et al.
5,976,205 A 11/1999 Andrews et al.
5,980,852 A 11/1999 Gurns et al.
5,980,982 A 11/1999 Degawa et al.
5,985,228 A 11/1999 Corrigan et al.
6,001,008 A 12/1999 Fujimori et al.
6,001,174 A 12/1999 Fang
6,024,824 A 2/2000 Krech
6,027,659 A 2/2000 Billett
6,030,595 A 2/2000 Sumiya et al.
6,039,641 A 3/2000 Sung
6,054,183 A 4/2000 Zimmer et al.
6,093,280 A 7/2000 Kirchner et al.
6,106,382 A 8/2000 Sakaguchi
6,123,612 A 9/2000 Goers
6,125,612 A 10/2000 Main
6,159,087 A 12/2000 Briang et al.
6,159,286 A 12/2000 Sung
6,179,886 B1 1/2001 Gordeev et al.
6,190,240 B1 2/2001 Kinoshita et al.
6,193,770 B1 2/2001 Sung
6,196,911 B1 3/2001 Preston et al.
6,200,360 B1 3/2001 Imai et al.
6,206,942 B1 3/2001 Wood et al.
6,213,856 B1 4/2001 Cho et al.
6,217,413 B1 4/2001 Christianson
6,224,469 B1 5/2001 Ohmori et al.
6,258,138 B1 7/2001 DeVoe et al.
6,258,201 B1 7/2001 Krech
6,258,237 B1 7/2001 Gal-Or et al.
6,281,129 B1 8/2001 Easter et al.
6,284,556 B1 9/2001 Wang et al.
6,286,498 B1 9/2001 Sung
6,293,854 B1 9/2001 Kimura et al.
6,299,508 B1 10/2001 Gagliardi et al.
6,299,521 B1 10/2001 Morimura et al.
6,312,324 B1 11/2001 Mitsui et al.
6,319,108 B1 11/2001 Adefris et al.
6,325,709 B1 12/2001 Nanda et al.
6,346,202 B1 2/2002 Molnar
6,354,918 B1 3/2002 Togawa et al.
6,354,929 B1 3/2002 Adefris et al.
6,368,198 B1 4/2002 Sung et al.
6,371,838 B1 4/2002 Holzapfel
6,371,842 B1 4/2002 Romero
6,372,001 B1 4/2002 Omar et al.
6,394,886 B1 5/2002 Chen et al.
6,409,580 B1 6/2002 Lougher et al.
6,416,878 B2 7/2002 An
6,419,574 B1 7/2002 Takahashi et al.
6,439,986 B1 8/2002 Myoung et al.
6,446,740 B2 9/2002 Eyre
6,458,018 B1 10/2002 Goers et al.
6,478,831 B2 11/2002 Tselesin
6,497,853 B1 12/2002 Davies et al.
6,544,599 B1 4/2003 Brown et al.
6,551,176 B1 4/2003 Garretson
6,605,798 B1 8/2003 Cullen
6,607,423 B1 8/2003 Arcayan et al.
6,616,725 B2 9/2003 Cho et al.
6,616,752 B1 9/2003 Basura
6,626,167 B2 9/2003 Kim et al.
6,627,168 B1 9/2003 Ohtsubo et al.
6,629,884 B1 10/2003 Goers
6,646,725 B1 11/2003 Eichinger
6,672,943 B2 1/2004 Vogtmann
6,679,243 B2 1/2004 Sung
6,692,547 B2 2/2004 Kim
6,694,847 B2 2/2004 Hiroyasu et al.
6,722,952 B2 4/2004 Goers et al.
6,749,485 B1 6/2004 James et al.
6,755,720 B1 6/2004 Ishizaki et al.
6,769,969 B1 8/2004 Duescher
6,790,126 B2 9/2004 Wood et al.
6,818,029 B2 11/2004 Myoung et al.
6,824,455 B2 11/2004 Osterheld et al.
6,835,365 B1 12/2004 Stewart et al.
6,837,979 B2 1/2005 Uzoh et al.
6,884,155 B2 4/2005 Sung et al.

(56) References Cited

U.S. PATENT DOCUMENTS 6,899,592 B1 5/2005 Kojima et al.
6,905,571 B2 6/2005 Sakuma et al.
6,935,365 B2 8/2005 Schuster
6,945,857 B1 9/2005 Doan et al.
6,979,357 B2 12/2005 Fries et al.
7,021,995 B2 4/2006 Toge et al.
7,033,408 B2 4/2006 Fries et al.
7,044,990 B2 5/2006 Ishizaki et al.
7,066,795 B2 6/2006 Balagani et al.
7,067,903 B2 6/2006 Tachibana et al.
7,124,753 B2 10/2006 Sung
7,150,677 B2 12/2006 Yamashita et al.
7,198,553 B2 4/2007 Goers
7,201,645 B2 4/2007 Sung
7,247,577 B2 7/2007 Palmgren et al.
7,258,708 B2 8/2007 Sung
7,261,621 B2 8/2007 Moon et al.
7,323,049 B2 1/2008 Sung
7,368,013 B2 5/2008 Sung
7,384,436 B2 6/2008 Sung
7,393,264 B1 7/2008 Sung
7,404,857 B2 7/2008 Sung
7,465,217 B2 12/2008 Kinoshita et al.
7,494,404 B2 2/2009 Sung
7,507,267 B2 3/2009 Hall et al.
7,585,366 B2 9/2009 Sung
7,641,538 B2 1/2010 Goers
7,651,368 B2 1/2010 Kendall et al.
7,651,386 B2 1/2010 Sung
7,658,666 B2 2/2010 Sung
7,690,971 B2 4/2010 Sung
7,762,872 B2 7/2010 Sung
7,791,188 B2 9/2010 Sung
7,840,305 B2 11/2010 Behr et al.
7,954,483 B2 6/2011 Kim et al.
8,104,464 B2 1/2012 Sung
8,377,158 B2 2/2013 Palmgren et al.
8,393,934 B2 * 3/2013 Sung ..... B24D 3/007 451/443
8,398,466 B2 3/2013 Sung et al.
8,545,583 B2 10/2013 Duescher
8,622,787 B2 * 1/2014 Sung ..... B24B 53/017 451/443
8,678,878 B2 3/2014 Sung
8,777,699 B2 7/2014 Sung
8,974,270 B2 * 3/2015 Sung ..... B24B 53/017 451/443
9,138,862 B2 * 9/2015 Sung ..... B24B 53/017
2001/0003884 A1 6/2001 Wei et al.
2001/0009844 A1 7/2001 Cho et al.
2001/0046835 A1 11/2001 Wielonski et al.
2002/0014041 A1 2/2002 Baldonai et al.
2002/0042200 A1 4/2002 Fawcett
2002/0077037 A1 6/2002 Tietz
2002/0127962 A1 9/2002 Cho et al.
2002/0139680 A1 10/2002 George
2002/0164928 A1 11/2002 Tolles
2002/0173234 A1 11/2002 Sung et al.
2002/0182401 A1 12/2002 Lawing
2003/0054746 A1 3/2003 Nussbaumer
2003/0084894 A1 5/2003 Sung
2003/0092357 A1 5/2003 Yoon et al.
2003/0114094 A1 6/2003 Myoung et al.
2003/0207659 A1 11/2003 Annen et al.
2004/0009742 A1 1/2004 Lin et al.
2004/0023610 A1 2/2004 Hu et al.
2004/0048557 A1 3/2004 Nabeya
2004/0060243 A1 4/2004 Fries et al.
2004/0079033 A1 4/2004 Long
2004/0091627 A1 5/2004 Ohara et al.
2004/0107648 A1 6/2004 Sung
2004/0112359 A1 6/2004 Sung
2004/0180617 A1 9/2004 Goers
2004/0185763 A1 9/2004 Ishizaki et al.
2004/0203325 A1 10/2004 Donohue
2004/0235406 A1 11/2004 Duescher
2004/0238946 A1 12/2004 Tachibana et al.
2005/0032462 A1 2/2005 Gagliardi et al.
2005/0032469 A1 2/2005 Duescher
2005/0060941 A1 3/2005 Provow
2005/0095959 A1 5/2005 Sung
2005/0118939 A1 6/2005 Duescher
2005/0215188 A1 9/2005 Toge et al.
2005/0227590 A1 10/2005 Sung
2005/0260939 A1 11/2005 Andrews et al.
2006/0073774 A1 4/2006 Sung
2006/0079160 A1 4/2006 Balagani et al.
2006/0079162 A1 4/2006 Yamashita et al.
2006/0128288 A1 6/2006 An et al.
2006/0135050 A1 6/2006 Petersen et al.
2006/0143991 A1 7/2006 Sung
2006/0213128 A1 9/2006 Sung
2006/0254154 A1 11/2006 Huang et al.
2006/0258276 A1 11/2006 Sung
2007/0051354 A1 3/2007 Sung
2007/0051355 A1 3/2007 Sung
2007/0060026 A1 3/2007 Sung
2007/0066194 A1 3/2007 Wielonski et al.
2007/0093181 A1 4/2007 Lugg et al.
2007/0128994 A1 6/2007 Sung
2007/0155298 A1 7/2007 Sung
2007/0167117 A1 7/2007 Moon et al.
2007/0232074 A1 10/2007 Ravi et al.
2007/0249270 A1 10/2007 Sung
2007/0254566 A1 11/2007 Sung
2007/0264918 A1 11/2007 Sung
2007/0266639 A1 11/2007 Sung
2007/0295267 A1 12/2007 Sung
2008/0014845 A1 1/2008 Yimaz et al.
2008/0076338 A1 3/2008 Andrews et al.
2008/0096479 A1 4/2008 Sung
2008/0153398 A1 6/2008 Sung
2008/0171503 A1 7/2008 Sung
2008/0271384 A1 11/2008 Puthanangady et al.
2008/0292869 A1 11/2008 Sung
2008/0296756 A1 12/2008 Koch et al.
2009/0068937 A1 3/2009 Sung
2009/0073774 A1 3/2009 Horesh
2009/0093195 A1 4/2009 Sung
2009/0094902 A1 4/2009 Hou
2009/0123705 A1 5/2009 Sung
2009/0145045 A1 6/2009 Sung
2009/0215363 A1 8/2009 Sung
2009/0283089 A1 11/2009 Sung
2010/0015898 A1 1/2010 An et al.
2010/0022174 A1 1/2010 Chou et al.
2010/0139174 A1 6/2010 Sung
2010/0186479 A1 7/2010 Borucki et al.
2010/0203811 A1 8/2010 Philipossian et al.
2010/0221990 A1 9/2010 Sung
2010/0248595 A1 9/2010 Dinh-Ngoc et al.
2010/0248596 A1 9/2010 Sung
2010/0261419 A1 10/2010 Sung
2010/0273402 A1 10/2010 Shimizu
2011/0076925 A1 3/2011 Sung
2011/0104989 A1 5/2011 Boutaghou et al.
2011/0192652 A1 8/2011 Shen et al.
2011/0212670 A1 9/2011 Sung
2011/0252710 A1 10/2011 Hall et al.
2011/0275288 A1 11/2011 Sung
2011/0293905 A1 12/2011 Sung
2011/0296766 A1 12/2011 Sung
2012/0192499 A1 8/2012 Sung
2012/0241943 A1 9/2012 Sung
2012/0244790 A1 9/2012 Sung
2012/0260582 A1 10/2012 Sung
2012/0302146 A1 11/2012 Sung
2013/0225052 A1 8/2013 Song et al.

(56) References Cited

U.S. PATENT DOCUMENTS

| | | | |
|---|---|---|---|
| 2013/0244552 | A1 | 9/2013 | Lee et al. |
| 2014/0099868 | A1 | 4/2014 | Sung |

FOREIGN PATENT DOCUMENTS

| | | |
|---|---|---|
| EP | 0712941 | 5/1966 |
| EP | 0238434 | 3/1987 |
| EP | 0280657 | 8/1988 |
| EP | 0331344 | 2/1989 |
| EP | 0264674 | 9/1995 |
| EP | 1075898 | 2/2001 |
| GB | 2239011 | 6/1991 |
| GB | 2366804 | 3/2002 |
| JP | 06182184 | 4/1994 |
| JP | 10128654 | 5/1998 |
| JP | 10180618 | 7/1998 |
| JP | 11048122 | 2/1999 |
| JP | 11077536 | 3/1999 |
| JP | 2000/167774 | 6/2000 |
| JP | 2000/343436 | 12/2000 |
| JP | 2003/071718 | 3/2003 |
| JP | 2004/025401 | 1/2004 |
| JP | 2007/044823 | 2/2007 |
| KR | 10/2002/0036138 | 5/2002 |
| KR | 20/0339181 | 1/2004 |
| KR | 10/2007/0063569 | 6/2007 |
| WO | WO 94/27883 | 12/1994 |
| WO | WO 95/27596 | 10/1995 |
| WO | WO 95/31006 | 11/1995 |
| WO | WO 96/06732 | 3/1996 |
| WO | WO 98/10897 | 3/1998 |
| WO | WO 98/45091 | 3/1998 |
| WO | WO 98/51448 | 3/1998 |
| WO | WO 98/45092 | 10/1998 |
| WO | WO 02/31078 | 4/2002 |
| WO | WO 2004/094106 | 11/2004 |
| WO | WO 2006/039413 | 4/2006 |
| WO | WO 2006/124792 | 11/2006 |
| WO | WO 2007/032946 | 3/2007 |
| WO | WO 2008/063599 | 5/2008 |
| WO | WO 2009/043058 | 4/2009 |
| WO | WO 2009/064677 | 5/2009 |
| WO | WO 2012/040374 A2 | 3/2012 |

OTHER PUBLICATIONS

Endecott's Specifications; 2004.

Kennametal Specification for DMHPM002 Hot Press Matrix N-50 Dec. 6, 2001.

Material Safety Data Sheet (MSDS), Wall Colmonoy Corporation; prepared Jul. 20, 1989.

Material Safety Data Sheet MSDS); Kennametal; issued Jun. 11, 2004.

Sung et al.; The Eastern Wind of Diamond Symthesis; New Diamond and Frontier Carpon Technology; 2003; pp. 47-61; vol. 13, No. 1.

Sung et al; Mechanism of the Solvent-Assisted Graphite to Diamond Transition Under High Pressure: Implications for the Selection of Catalysts, High Temperatures-High Pressure; 1995/1996; pp. 523-546; vol. 27/28.

Syndite, CTM302; Announcement, Elementsix Advancing Diamond; Jan. 14, 2003; http://www.e6.com/en/resourches/announcementsheets/CTM302.pdf; as accessed on Dec. 16, 2008.

Yasunaga et al; Advances in Abrasive Technology, III; Soc. of Grinding Engineers (SGE) in Japan; 2000. (Abstract Only).

U.S. Appl. No. 12/726,786, filed Mar. 18, 2010; Chien-Min Sung; office action dated Mar. 19, 2013.

U.S. Appl. No. 13/021,350, filed Feb. 4, 2011; Chien-Min Sung; office action dated Mar. 20, 2013.

U.S. Appl. No. 13/362,917, filed Jan. 31, 2012; Chien-Min Sung; office action dated Apr. 10, 2013.

U.S. Appl. No. 13/239,189, filed Sep. 21, 2011; Chien-Min Sung; notice of allowance dated May 3, 2013.

U.S. Appl. No. 13/239,198, filed Sep. 21, 2011; Chien-Min Sung; office action dated Jul. 23, 2013.

PCT/U52013/042538; filed May 23, 2013; Chien-Min Sung; international search report dated Aug. 27, 2013.

U.S. Appl. No. 12/726,786, filed Mar. 18, 2010; Chien-Min Sung; notice of allowance dated Sep. 4, 2013.

U.S. Appl. No. 13/113,779, filed May 23, 2011; Chien-Min Sung; office action dated Nov. 12, 2013.

U.S. Appl. No. 13/153,176, filed Jun. 3, 2011; Chien-Min Sung; office action dated Dec. 6, 2013.

U.S. Appl. No. 13/239,198, filed Sep. 21, 2011; Chien-Min Sung; Notice of Allowance mailed Mar. 4, 2014.

U.S. Appl. No. 12/255,823, filed Oct. 22, 2008; Chien-Min Sung; notice of allowance dated Dec. 26, 2012.

U.S. Appl. No. 12/267,172, filed Nov. 7, 2008; Chien-Min Sung; notice of allowance dated Oct. 22, 2012.

U.S. Appl. No. 12/168,110, filed Jul. 5, 2008; Chien-Min Sung; notice of allowance dated Jan. 18, 2013.

U.S. Appl. No. 12/255,823, filed Oct. 22, 2005; Chien-Min Sung; office action issued Mar. 7, 2012.

U.S. Appl. No. 12/168, 110, filed Jul. 5, 2008; Chien-Min Sung; office action issued May 14, 2012.

U.S. Appl. No. 12/715,583, filed Mar. 2, 2010; Chien-Min Sung; office action issued Mar. 21, 2012.

U.S. Appl. No. 11/805,549, filed May 22, 2007; Chien-Min Sung; office action issued Oct. 6, 2010.

U.S. Appl. No. 12/267,172, filed Nov. 7, 2008; Chien-Min Sung; office action dated Jul. 9, 2012.

U.S. Appl. No. 12/267,172, filed Nov. 7, 2008; Chien-Min Sung; office action issued Jan. 3, 2012.

U.S. Appl. No. 12/328,338, filed Dec. 4, 2008; Chien-Min Sung; office action dated Mar. 20, 2014.

U.S. Appl. No. 13/153,176, filed Jun. 3, 2011; Chien-Min Sung; office action dated Jul. 1, 2014.

U.S. Appl. No. 13/113,779, filed May 23, 2011; Chien-Min Sung; office action dated Jul. 2, 2014.

PCT Application PCT/US2011/052627; filed Sep. 21, 2011; Chien-Min Sung; international search report mailed May 11, 2012.

PCT Application PCT/US2012/039,199; filed May 23, 2012; Chien-Min Sung; international search report dated Dec. 18, 2012.

U.S. Appl. No. 12/168,110, filed Jul. 5, 2008; Chien-Min Sung; office action dated May 14, 2012.

U.S. Appl. No. 12/059,422, filed Mar. 31, 2008; Chien-Min Sung; office action dated Jan. 24, 2013.

U.S. Appl. No. 12/715,583, filed Mar. 2, 2010; Chien-Min Sung; notice of allowance dated Dec. 7, 2012.

U.S. Appl. No. 13/362,917, filed Jan. 31, 2012; Chien-Min Sung office action dated Jun. 14, 2012.

U.S. Appl. No. 12/059,422, filed Mar. 20, 2008; Chien-Min Sung; office action dated Aug. 22, 2012.

U.S. Appl. No. 13/239,189, filed Sep. 21, 2011; Chien-Min Sung; office action dated Dec. 21, 2012.

U.S. Appl. No. 13/362,917, filed Jan. 13, 2012; Chien-Min Sung; office action dated Dec. 31, 2012.

U.S. Appl. No. 12/255,823, filed Oct. 21, 2008; Chien-Min Sung; notice of allowance dated Sep. 21, 2012.

U.S. Appl. No. 12/168,110, filed Jul. 5, 2008; Chien-Min Sung; notice of allowance dated Sep. 28, 2012.

U.S. Appl. No. 12/267,172, filed Nov. 7, 2008; Chien-Min Sung; notice of allowance dated Jan. 7, 2013.

U.S. Appl. No. 13/479,148, filed May 23, 2012; Chien-Min Sung; office action dated May 15, 2014.

U.S. Appl. No. 13/407,634, filed Feb. 28, 2012; Chien-Min Sung; office action dated Jun. 13, 2014.

U.S. Appl. No. 13/644,790, filed Oct. 4, 2012; Chien-Min Sung; office action dated Jun. 17, 2014.

U.S. Appl. No. 13/416,201, filed Mar. 9, 2012; Chien-Min Sung; office action dated Jun. 18, 2014.

PCT Application PCT/US2007/024165; filed Nov. 16, 2007; Chien-Min Sung; Internaitonal Search Report mailed May 23, 2011.

(56) References Cited

OTHER PUBLICATIONS

PCT Application PCT/US2011/052626; filing date Sep. 21, 2011; Chien-Min Sung; International Search Report mailed May 2, 2012.
U.S. Appl. No. 12/715,583, filed Mar. 2, 2010; Chien-Min Sung; office action issued Aug. 9, 2012.
U.S. Appl. No. 12/715,583, filed Mar. 2, 2010; Chien-Min Sung; office action issued Oct. 25, 2011.
U.S. Appl. No. 12/328,338, filed Dec. 4, 2008; Chien-Min Sung; office action issued May 10, 2011.
U.S. Appl. No. 13/021,350, filed Feb. 4, 2011; Chien-Min Sung; office action issued Aug. 31, 2011.
U.S. Appl. No. 13/021,350, filed Feb. 4, 2011; Chien-Min Sung; office action issued Feb. 7, 2012.
U.S. Appl. No. 13/794,164, filed Mar. 11, 2013; Chien-Min Sung; office action dated Jul. 16, 2014.
U.S. Appl. No. 13/113,779, filed May 23, 2011; Chien-Min Sung; office action dated Oct. 9, 2014.
U.S. Appl. No. 13/153,176, filed Jun. 3, 2011; Chien-Min Sung; office action dated Oct. 10, 2014.
U.S. Appl. No. 13/407,634, filed Feb. 28, 2012; Chien-Min Sung; office action dated Oct. 29, 2014.
U.S. Appl. No. 13/802,112, filed Mar. 13, 2013; Chien-Min Sung; office action dated Nov. 6, 2014.
U.S. Appl. No. 12/328,338, filed Dec. 4, 2008; Chien-Min Sung; Notice of Allowance mailed Nov. 21, 2014.
U.S. Appl. No. 13/479,148, filed May 23, 2012; Chien Min-Sung; Notice of Allowance mailed Dec. 9, 2014.
U.S. Appl. No. 13/644,790, filed Oct. 4, 2012; Chien-Min Sung; office action dated Dec. 24, 2014.
U.S. Appl. No. 13/797,704, filed Mar. 12, 2013; Chien-Min Sung; office action dated Jan. 12, 2015.
U.S. Appl. No. 13/479,148, filed May 23, 2012; Chien-Min Sung; Notice of Allowance mailed Jan. 12, 2015.
U.S. Appl. No. 13/416,201, filed Mar. 9, 2012; Chien-Min Sung; office action dated Jan. 22, 2015.
U.S. Appl. No. 13/113,779, filed May 23, 2011; Chien-Min Sung; office action dated Feb. 10, 2015.
U.S. Appl. No. 13/153,176, filed May 3, 2011; Chien-Min Sung; office action dated Feb. 10, 2015.
U.S. Appl. No. 13/633,082, filed Oct. 1, 2012; Chien-Min Sung; Office Action dated Feb. 26, 2015.
U.S. Appl. No. 13/407,634, filed Feb. 28, 2012; Chien-Min Sung; Office Action dated Mar. 5, 2015.
U.S. Appl. No. 14/248,163, filed Apr. 8, 2014; Chien-Min Sung; Office Action dated Apr. 28, 2015.
U.S. Appl. No. 13/416,201, filed Mar. 9, 2012; Chien-Min Sung; Office Action dated May 15, 2015.
U.S. Appl. No. 13/644,790, filed Oct. 4, 2012; Chien-Min Sung; Notice of Allowance mailed Jun. 8, 2015.
U.S. Appl. No. 13/802,112, filed Mar. 13, 2013; Chien-Min Sung; Notice of Allowance mailed May 15, 2015.
U.S. Appl. No. 13/113,779, filed May 23, 2011; Chien-Min Sung; Notice of Allowance mailed Jul. 17, 2015.
U.S. Appl. No. 13/153,176, filed Jun. 3, 2011; Chien-Min Sung; Office Action dated Aug. 13, 2015.
U.S. Appl. No. 13/633,082, filed Oct. 1, 2012; Chien-Min Sung; Notice of Allowance mailed Aug. 19, 2015.
U.S. Appl. No. 13/407,634, filed Feb. 28, 2012; Chien-Min Sung; Notice of Allowance mailed Sep. 3, 2015.
U.S. Appl. No. 14/223,810, filed Mar. 24, 2014; Chien-Min Sung; Office Action dated Oct. 8, 2015.
U.S. Appl. No. 14/120,976, filed Jul. 15, 2014; Chien-Min Sung; Office Action dated Oct. 15, 2015.
U.S. Appl. No. 13/846,740, filed Mar. 18, 2013; Chien-Min Sung; Office Action dated Nov. 4, 2015.

* cited by examiner

CMP PAD DRESSERS HAVING LEVELED TIPS AND ASSOCIATED METHODS

PRIORITY DATA

This application is a continuation-in-part of U.S. patent application Ser. No. 13/802,112, filed on Mar. 13, 2013, which is a continuation-in-part of U.S. patent application Ser. No. 13/479,148, filed on May 23, 2012, which claims the benefit of U.S. Provisional Patent Application Ser. No. 61/489,074, filed on May 23, 2011. This application is also a continuation-in-part of U.S. patent application Ser. No. 13/797,704, filed Mar. 12, 2013, which is a continuation-in-part of U.S. patent application Ser. No. 12/726,786, filed on Mar. 18, 2010, which is a is a continuation-in-part of U.S. patent application Ser. No. 12/255,823, filed Oct. 22, 2008, which is a continuation-in-part of U.S. patent application Ser. No. 12/168,110, filed on Jul. 5, 2008, which claims the benefit of U.S. Provisional Patent Application Ser. No. 60/976,198, filed Sep. 28, 2007. U.S. patent application Ser. No. 12/726,786, filed on Mar. 18, 2010 is also a continuation-in-part of U.S. patent application Ser. No. 11/560,817, filed Nov. 16, 2006, which is a continuation-in-part of U.S. patent application Ser. No. 11/357,713, filed Feb. 17, 2006, which claims the benefit of U.S. Provisional Patent Application Ser. No. 60/681,798, filed May 16, 2005. U.S. patent application Ser. No. 11/560,817 is additionally a continuation-in-part of U.S. patent application Ser. No. 11/223,786, filed Sep. 9, 2005. U.S. patent application Ser. No. 13/797,704 is also a continuation-in-part of U.S. patent application Ser. No. 12/850,747, filed Aug. 5, 2010, which claims the benefit of U.S. Provisional Patent Application Ser. No. 61/246,816, filed on Sep. 29, 2009. U.S. patent application Ser. No. 13/797,704 is further a continuation-in-part of U.S. patent application Ser. No. 13/034,213, filed Feb. 24, 2011, which claims the benefit of U.S. Provisional Patent Application Ser. No. 61/333,162, filed on May 10, 2010. Each of these applications is incorporated herein by reference.

BACKGROUND OF THE INVENTION

The semiconductor industry currently spends in excess of one billion U.S. dollars each year manufacturing silicon wafers that must exhibit very flat and smooth surfaces. Known techniques to manufacture smooth and even-surfaced silicon wafers are plentiful. The most common of these involves the process known as Chemical Mechanical Polishing (CMP) which includes the use of a polishing pad in combination with an abrasive slurry. Of central importance in all CMP processes is the attainment of high performance levels in aspects such as uniformity of polished wafer, smoothness of the IC circuitry, removal rate for productivity, longevity of consumables for CMP economics, etc.

SUMMARY OF THE INVENTION

The present disclosure provides CMP pad dressers and associated methods, including without limitation, methods directed to the manufacture and use of such dressers. In one aspect, for example, a CMP pad dresser can include a support substrate and a plurality of superabrasive particles secured to the support substrate with each superabrasive particle extending away from the support substrate to a protrusion distance. The plurality of superabrasive particles can be positioned such that the highest protruding tip of each of the plurality of superabrasive particles align along a designated profile with a tip variation of from about 5 microns to about 100 microns. In another aspect, the highest protruding tip of each of the plurality of superabrasive particles align along the designated profile with a tip variation of from about 10 microns to about 50 microns. In yet another aspect, the highest protruding tip of each of the plurality of superabrasive particles align along the designated profile with a tip variation of from about 20 microns to about 40 microns. In a further aspect, the highest protruding tip of each of the plurality of superabrasive particles align along the designated profile with a tip variation of less than about 20 microns. The designated profile can include any geometric configuration that can be useful in dressing a CMP pad, and any such configuration is considered to be within the present scope. Non-limiting examples can include a plane, a slope, a curved shape, a dome shape, and the like, including appropriate combinations thereof.

The positioning of superabrasive particles relative to the support substrate can also be described in terms of the depths that the superabrasive particles cut into a CMP pad when used to abrade the CMP pad. In one aspect, for example, the protrusions of the plurality of superabrasive particles produce cutting depths of less than about 20 microns when used to abrade a CMP pad. In another aspect, the protrusions of the plurality of superabrasive particles produce cutting depths of from about 1 micron to about 20 microns when used to abrade a CMP pad. In yet another aspect, the protrusions of the plurality of superabrasive particles produce cutting depths of from about 10 microns to about 20 microns when used to abrade a CMP pad.

As another exemplary aspect of the present disclosure, a CMP pad dresser can include a rigid support substrate and a monolayer of a plurality of superabrasive particles coupled to the support substrate, where each superabrasive particle in the monolayer extends from the support substrate to a protrusion distance. In one aspect, the difference in protrusion distance between the highest protruding tip and the second highest protruding tip of the monolayer of superabrasive particles is less than or equal to about 50 microns, and the difference in protrusion distance between the highest 1% of the protruding tips of the monolayer of superabrasive particles is within about 80 microns or less. In another aspect, the difference in protrusion distance between the highest protruding tip and the second highest protruding tip is less than or equal to about 10 microns. In yet another aspect, the difference in protrusion distance between the highest protruding tip and the second highest protruding tip is less than or equal to about 10 microns. In a further aspect, the difference in protrusion distance between the highest protruding tip and the $10^{th}$ highest protruding tip is less than or equal to about 20 microns. In yet another aspect, the difference in protrusion distance between the highest protruding tip and the $100^{th}$ highest protruding tip is less than or equal to about 40 microns.

As yet another exemplary aspect of the present disclosure, a CMP pad dresser can include a rigid support substrate and a monolayer of a plurality of superabrasive particles coupled to the support substrate, where the plurality of superabrasive particles includes a plurality of working superabrasive particles, such that rotating the dresser against a CMP pad cuts asperities into the CMP pad having a cutting depth of less than or equal to about 50 microns. In another aspect, the cutting depth is from about 10 microns to about 50 microns. In yet another aspect, the plurality of working superabrasive particles includes at least 100 working superabrasive particles. In a further aspect, the plurality of working superabrasive particles includes at least 1000 working superabrasive particles. In yet another aspect, the plurality of working superabrasive particles includes from about 1000 to about 6000 working superabrasive particles. In another aspect, the plurality of working superabrasive particles includes from about 2000 to about 5000 working superabrasive particles. In a further aspect, the plurality of working superabrasive particles include at least about 1000 working superabrasive particles that protrude from the rigid support substrate to distances within about 30 microns of one another.

As another exemplary aspect of the present disclosure, a method of dressing a CMP pad can include applying a CMP pad dresser to a CMP pad, and moving at least one of the CMP pad or the CMP pad dresser with respect to one another to cut asperities into the CMP pad having a cutting depth of from about 10 microns to about 50 microns.

As a further exemplary aspect of the present disclosure, a CMP pad dresser is provided including a support substrate and a plurality of superabrasive particles secured to the support substrate and positioned to engage and dress a CMP pad, where the plurality of superabrasive particles cut to depths of less than 50 microns into a CMP pad during a dressing procedure.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

Figure 1:
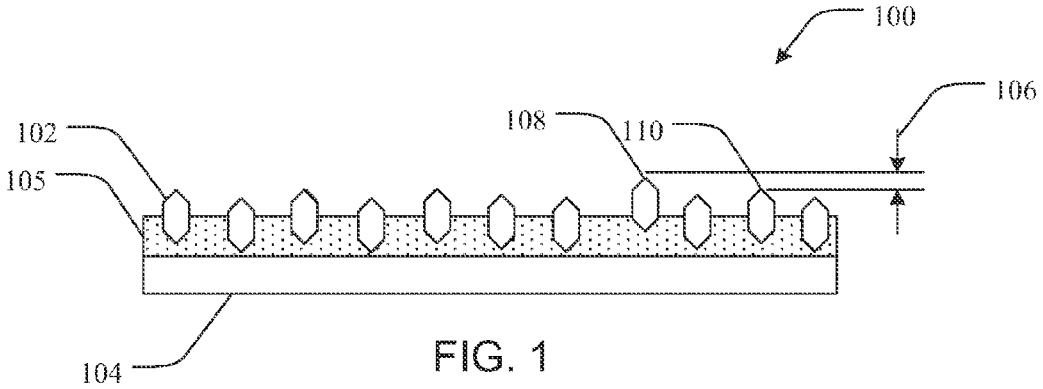
FIG. 1 is a schematic side view of a CMP pad dresser in accordance with an embodiment of the present disclosure.

It will be understood that the above figures are merely for illustrative purposes in furthering an understanding of the invention. Further, the figures are not drawn to scale, thus dimensions, particle sizes, and other aspects may, and generally are, exaggerated to make illustrations thereof clearer. Therefore, departure can be made from the specific dimensions and aspects shown in the figures in order to produce the heat spreaders of the present invention.

DETAILED DESCRIPTION

Before the present invention is disclosed and described, it is to be understood that this invention is not limited to the particular structures, method steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an" and, "the" include plural referents unless the context clearly dictates otherwise. Thus, for example, reference to "a diamond particle" includes one or more of such particles and reference to "the layer" includes reference to one or more of such layers.

DEFINITIONS

In describing and claiming the present invention, the following terminology will be used in accordance with the definitions set forth below.

As used herein, the terms "conditioner" and "dresser" can be used interchangeably, and refer to a tool used to condition or dress a pad, such as a CMP pad.

As used herein, "superabrasive" may be used to refer to any crystalline, or polycrystalline material, or mixture of such materials that has a Mohr's hardness of about 8 or greater. In some aspects, the Mohr's hardness may be about 9.5 or greater. In other aspects, superabrasive materials can be materials having a Vicker's hardness of about 4000 $Kg/mm^2$ or greater. Suitable superabrasive material examples can include, without limitation, diamond, polycrystalline diamond (PCD), cubic boron nitride (cBN), polycrystalline cubic boron nitride (PcBN), corundum and sapphire, as well as other superabrasive materials known to those skilled in the art. Superabrasive materials may be incorporated into various tools in a variety of forms including particles, grits, films, layers, pieces, segments, etc. While superabrasive materials are very inert and thus difficult to form chemical bonds with, it is known that certain reactive elements, such as chromium and titanium are capable of chemically reacting with superabrasive materials at certain temperatures.

As used herein, "particle" refers, when used in connection with superabrasive particles, to a particulate form of superabrasive particle. Such particles may take a variety of shapes, including round, oblong, square, euhedral, etc., can be either single crystal or polycrystalline, and can have a number of mesh sizes. As is known in the art, "mesh" refers to the number of holes per unit area, as in the case of U.S. meshes. All mesh sizes referred to herein are U.S. mesh unless otherwise indicated. Further, mesh sizes are generally understood to indicate an average mesh size of a given collection of particles since each particle within a particular "mesh size" may actually vary over a small distribution of sizes, unless noted otherwise.

As used herein, "working superabrasive particles" are superabrasive particles that cut or otherwise deform a CMP pad during a dressing or conditioning procedure. This action can remove debris from the surface, it can deform the surface either elastically or plastically, or it can create a groove or asperity in the surface of the CMP pad. In one specific aspect, a working superabrasive particle can cut deeper than about 10 microns into a CMP pad during a dressing procedure.

As used herein, "non-working superabrasive particles" are superabrasive particles in a CMP pad dresser that do not significantly cut or deform the pad sufficient to remove debris from the surface, deform the surface, or create grooves in the surface.

As used herein, "overly-aggressive superabrasive particles" are superabrasive particles in a CMP pad dresser that aggressively dress or condition a CMP pad. In one aspect, aggressive superabrasive particles are superabrasive particles that cut deeper than about 50 microns into a CMP pad during a dressing procedure. In another aspect, aggressive superabrasive particles are superabrasive particles that remove at least ⅕ of the material from the CMP pad. In yet another aspect, aggressive superabrasive particles are superabrasive particles that remove at least ½ of the material from the CMP pad.

As used herein, "working end" refers to an end of a particle that is oriented towards the CMP pad and that during a dressing operation makes contact with the pad. In many cases the working end of a particle will be distal from a substrate to which the particle is attached.

As used herein, cutting "tip" refers to a portion of a cutting element or particle that protrudes the greatest distance from the support substrate, e.g., that is the first portion of the cutting element that contacts a CMP pad when in use. It is to be understood that a cutting "tip" can include a planar surface, a pointed surface, or an edge; so long as the planar surface, pointed surface or edge of the cutting element is the first portion of the cutting element that contacts a CMP pad from which material is to be removed.

As used herein, "sharp portion" refers to any narrow portion to which a crystal or particle may converge, including but not limited to corners, apexes, ridges, edges, obelisks, and other protrusions. In some cases, corners and/or apexes are formed at the convergence of more than two faces of the particle or crystal, or other body, disposed in intersecting planes. In other aspects, edges and/or ridges may be formed at the convergence of two or at least two faces of the particle or crystal, or other body, disposed in intersecting planes. In some aspects, "sharp portion" can include a portion that is broken, chipped, cracked, jagged, and the like. In some aspects, degrees of sharpness can be correlated with the geometric angle formed by the particle, crystal, or other body, at the location in question. In some aspects, an angle of 90 degrees or less can be considered sharp. In other aspects, an angle of 60 degrees or less can be considered sharp. In yet other aspects, and angle of 45 degrees or less, or 30 degrees or less can be considered to be sharp.

As used herein, cutting "edge" refers to a portion of a cutting element or particle that includes some measurable width across a portion that contacts and removes material from a workpiece. As an exemplary illustration, a typical knife blade has a cutting edge that extends longitudinally along the knife blade, and the knife blade would have to be oriented transversely to a workpiece to scrape or plane material from the workpiece in order for the cutting "edge" of the knife blade to remove material from the workpiece.

As used herein, "peripherally located," "peripheral location," and the like, refer to any particle or other cutting element of a dresser that is located in an area that originates at the leading edge or outer rim of a dresser and extends inwardly towards the center for up to about 90% of the radius of the dresser. In some aspects, the area may extend inwardly from about 20% to 90% of the radius. In other aspects, the area may extend in to about 50% of the radius. In yet another aspect, the area may extend in to about 33% of the radius of a dresser (i.e. 66% away from the center).

As used herein, "centrally located particle," "particle in a central location," and the like refer to any particle or other cutting element of a tool that is located in an area of the tool that originates at a center point of the tool and extends outwardly towards the tool's edge for up to about 90% of the radius of the tool. In some aspects, the area may extend outwardly from about 20% to about 90% of the radius. In other aspects, the area may extend out to about 50% of the radius. In yet another aspect, the area may extend out to about 33% of the radius of a tool.

As used herein, "attitude" refers to the position or arrangement of a superabrasive particle in relation to a defined surface, such as a substrate to which it is attached, or a CMP pad to which it is to be applied during a work operation. For example, a superabrasive particle can have an attitude that provides a specific portion of the particle in orientation toward a CMP pad.

As used herein, "leading edge" refers to the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, the term "profile" and "geometric profile" can be used interchangeably, and refer to a predetermined contour above a support substrate to which a plurality of superabrasive particles or other cutting elements are intended to align. Examples of such profiles may include, without limitation, flat or planar profiles, curved profiles, wavy profiles, convex profiles, concave profiles, multi-tiered profiles, and the like, including combinations thereof.

As used herein, "geometric configuration" refers to a shape that is capable of being described in readily understood and recognized mathematical terms. Examples of shapes qualifying as "geometric configurations" include, without limitation, cubic shapes, polyhedral (including regular polyhedral) shapes, triangular shapes (including equilateral triangles, isosceles triangles and three-dimensional triangular shapes), pyramidal shapes, spheres, rectangles, "pie" shapes, wedge shapes, octagonal shapes, circles, etc.

As used herein, "dressing segment" refers to a dressing or conditioning element of a CMP pad dresser. In one aspect, dressing segments are utilized to carry superabrasive particles having leveled tips. Thus, in some cases superabrasive particles can be introduced into a CMP pad dresser by the incorporation of multiple dressing segments. It should be noted that a variety of techniques of attaching the dressing segments to the substrates, and a variety of techniques of attaching the superabrasive particles to the dressing segments, are possible, all of which are considered to be within the present scope. It is to be understood that all of these various attachment mechanisms can be used interchangeably herein: that is, if a method of attaching a dressing segment to a substrate is discussed herein, the method of attachment discussed can also be used to attach superabrasive particles to a dressing segment. For any particular CMP pad dresser being discussed, however, it is understood that attachment methods of the superabrasive particles to the dressing segments can differ from, or can be the same as, the method used to attach the dressing segments to the pad conditioner substrate.

As used herein, "cutting element" describes a variety of structures capable of removing (e.g., cutting) material from a CMP pad. A cutting element can be a mass having several cutting points, ridges or mesas formed thereon or therein. It is notable that such cutting points, ridges or mesas may be from a multiplicity of protrusions or asperities included in the mass. Furthermore, a cutting element can also refer an individual particle that may have only one cutting point, ridge or mesa formed thereon or therein.

As used herein, "organic material" refers to a semisolid or solid complex or mix of organic compounds. "Organic material layer" and "organic matrix" may be used interchangeably, and refer to a layer or mass of a semisolid or solid complex or mix of organic compounds, including resins, polymers, gums, etc. The organic material can be a polymer or copolymer formed from the polymerization of one or more monomers. In some cases, such organic material can be adhesive.

As used herein, the process of "brazing" is intended to refer to the creation of chemical bonds between the carbon atoms of the superabrasive particles/materials and the braze material. Further, "chemical bond" means a covalent bond, such as a carbide or boride bond, rather than mechanical or weaker inter-atom attractive forces. Thus, when "brazing" is used in connection with superabrasive particles a true chemical bond is being formed. However, when "brazing" is used in connection with metal to metal bonding the term is used in the more traditional sense of a metallurgical bond. Therefore, brazing of a superabrasive segment to a tool body does not necessarily require the presence of a carbide former.

As used herein, "mechanical bond" and "mechanical bonding" may be used interchangeably, and refer to a bond interface between two objects or layers formed primarily by frictional forces. In some cases the frictional forces between the bonded objects may be increased by expanding the contacting surface areas between the objects, and by imposing other specific geometrical and physical configurations, such as substantially surrounding one object with another.

As used herein, "sintering" refers to the joining of two or more individual particles to form a continuous solid mass. The process of sintering involves the consolidation of particles to at least partially eliminate voids between particles. Sintering may occur in either metal or carbonaceous particles, such as diamond. Sintering of metal particles occurs at various temperatures depending on the composition of the material. Sintering of diamond particles generally requires ultrahigh pressures and the presence of a carbon solvent as a diamond sintering aid. Sintering aids are often present to aid in the sintering process and a portion of such may remain in the final product.

The term "metallic" refers to both metals and metalloids. Metals include those compounds typically considered metals found within the transition metals, alkali and alkali earth metals. Examples of metals are Ag, Au, Cu, Al, and Fe. Metalloids include specifically Si, B, Ge, Sb, As, and Te. Metallic materials also include alloys or mixtures that include metallic materials. Such alloys or mixtures may further include additional additives. In the present invention, carbide formers and carbon wetting agents may be included as alloys or mixtures, but are not anticipated to be the only metallic component. Examples of such carbide formers are Sc, Y, Ti, Zr, Hf, V, Nb, Cr, Mo, Mn, Ta, W, and Tc. Examples of carbon wetting agents are Co, Ni, Mn, and Cr.

As used herein, "infiltrating" refers to a situation where a material is heated to its melting point and then flows as a liquid through the interstitial voids between particles.

As used herein, the terms "substrate" and "support substrate" can be used interchangeably, and refer a portion of a pad conditioner that supports superabrasive materials, and to which abrasive materials and/or superabrasive segments that carry abrasive materials may be affixed. Substrates can have a variety of shapes, thicknesses, and/or materials that are capable of supporting abrasive materials in a manner that is sufficient to provide a CMP pad dresser useful for its intended purpose. Substrates may be of a solid material, a powdered material that becomes solid when processed, or a flexible material. Examples of typical substrate materials include without limitation, metals, metal alloys, ceramics, relatively hard polymers or other organic materials, glasses, and mixtures thereof. Further, the substrate may include a material that aids in attaching abrasive materials to the substrate, including, without limitation, brazing alloy material, sintering aids and the like.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. However, it is to be understood that even when the term "about" is used in the present specification in connection with a specific numerical value, that support for the exact numerical value recited apart from the "about" terminology is also provided.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The Invention

The present disclosure generally provides CMP pad dressers, methods associated with pad conditioning (e.g., smoothing, polishing, dressing), and the CMP polishing of a work piece. Pad conditioners according to aspects of the present disclosure can be advantageously utilized, for example, in dressing CMP pads that are used in polishing, finishing or otherwise affecting semiconductor materials. Specifically, in some aspects the present disclosure concerns CMP pad dressers having superabrasive particles with substantially leveled tips. In other aspects, the present CMP pad dressers can have superabrasive particles that are aligned across a designated profile, and as such, are "leveled" with respect to that profile. Traditional CMP pad dresser manufacturing methods, even many of those describing techniques for leveling superabrasive particle tips prior to fixation, generally contain significant variation in tip height across the surface of the dresser that is not accounted for by an intended tip alignment profile. Often, the superabrasive particles are affixed to the CMP pad dresser support in a manner that disrupts any leveling that has occurred. For example, fixation techniques that utilize high heat and/or pressure can cause warping of the dresser support as the dresser cools. Thus, unless steps are taken to avoid such warpage, superabrasive particles are not maintained in their leveled state following cooling of the dresser. This can be particularly problematic with brazing techniques.

A CMP pad dresser can be used to dress or condition a CMP pad by removing dirt and debris (i.e. deglazing the pad), as well as opening up asperities in the pad surface to capture and hold chemical slurry during a polishing procedure. As has been described, due to difficulties associated with superabrasive particle leveling in many traditional manufacturing processes, only a small percentage of superabrasive particles in a typical CMP pad dresser are positioned so as to penetrate or cut into a CMP pad. As this small percentage of superabrasive particles become worn, plastic deformation of the CMP pad becomes large relative to the amount of CMP of pad that is cut. Consequently, the pad becomes highly deformed and accumulated with dirt. As a result the polishing rate of the CMP pad declines, and the scratch rate of the wafer or work piece increases.

CMP pads are typically made of a relatively soft polymer, such as, for example, polyurethane. As the CMP pad is engaged by the CMP pad dresser, the polymer material is deformed first by elastic strain and then by plastic strain. Eventually, the strain energy in the deformed material exceeds the bond energy density (i.e. the hardness of the pad) and the polymer material ruptures. Thus, the function of superabrasive particles in the CMP pad dresser is to dress the CMP pad material by breaking polymeric bonds through this deformation process. It should be noted that sharp superabrasive particle tips can penetrate the CMP pad material without causing excessive deformation. As such, the sharpness of a superabrasive particle can be defined as being inverse to the deformed volume prior to rupture. In other words, the smaller the volume of deformation prior to cutting, the sharper the cutting tip. This deformation information can be used to determine the sharpness of superabrasive particles in the CMP pad dresser.

Additionally, a superabrasive particle having a tip with smaller tip radius, such as would be the case with a broken corner, can cut more cleanly through the CMP pad with less deformation as compared to a superabrasive particle having a larger tip radius. Consequently, an irregularly shaped superabrasive particle tip can be sharper than a euhedral superabrasive corner having an obtuse angle relative to the CMP pad. This also applies to the difference between a superabrasive particle corner as compared with a superabrasive particle face.

It is thus noted that sharp superabrasive particle tips can cut CMP pad materials with less deformation and material strain. Conversely, a dull superabrasive particle may deform but not cut the CMP pad material because the strain energy does not exceed the bond energy density of the polymeric material. As the tips of such particles are worn, the contact area between the polymeric material and the particles increase. This increase in contact area results in an increase in the deformation volume of the pad. Due to the increased strain energy required for the polymeric material to rupture with such an increased deformation volume, the number of superabrasive particles cutting the polymeric material will decrease in relation to the degree of dulling during a CMP process.

CMP pad dressing can also be affected by the proportion of superabrasive particles in the CMP pad dresser that are working and the proportion that are overly-aggressively cutting. As an example, a typical CMP pad dresser can have greater than 10,000 superabrasive particles. Of these 10,000 particles, in some cases there may only be a few working superabrasive particles that are actually able to cut the CMP pad. Additionally, out of these few working superabrasive particles, there may be a smaller proportion of overly-aggressive superabrasive particles that cut over 50% of the entire pad that is consumed during conditioning, and in some cases can remove more that 25% of the total pad material. This uneven work load distribution can cause erratic CMP performance, and can result in over consumption of the CMP pad, chipping of the overly-aggressive superabrasive particles that can scratch the wafer, unpredictable wafer removal rates, uneven wafer surface planarization, shortened CMP pad dresser life, compaction of the CMP pad with debris, and the like. Such effects can greatly lower the yield of wafers or work pieces processed under these conditions. A more effective normalization of work load distribution across the surface of the CMP pad dresser can lead to a more uniformly deglazed pad and more uniform pad asperities.

The present CMP pad dressers include a layer of superabrasive particles having substantially leveled tips across the working surface of the finished CMP pad dresser. A variety of techniques can be utilized to maintain tip leveling, and any such technique is considered to be within the present scope. A few non-limiting examples of such techniques are described below. It is intended that the term "leveling" with respect to superabrasive particles can refer to superabrasive particles that are leveled with respect to a planar profile, as well as to superabrasive particles that are aligned along a designated profile that is non-planar. In the latter case, "leveling" would thus describe the alignment of the superabrasive particles along the designated profile. So in the case of a profile having a dome-shape, leveled superabrasive particles would be particles that were in alignment with the profile.

Furthermore, superabrasive tip alignment can additionally be described in terms of height distribution, or in some cases protrusion distance from the support substrate that is represented by a height distribution across the plurality of superabrasive particles. An even height distribution of superabrasive particles may function to more effectively preserve the integrity of the CMP pad dresser as compared to CMP pad dressers lacking such an even height distribution. Similarly, a plurality of superabrasive particles can be described as extending away from a support substrate to a predetermined height, represented by a protrusion distance from the substrate, where the predetermined heights of the particles align along a designated profile. Thus, the actual distribution of protrusion distances across the plurality of superabrasive particles in a finished dresser can be compared against the designated profile to determine the variance, or degree of "leveling" achieved.

In one aspect, for example, a CMP pad dresser is provided including a support substrate and a plurality of superabrasive particles secured to the support substrate, with each superabrasive particle extending away from the support substrate to a protrusion distance, where the highest protruding tip of each of the plurality of superabrasive particles align along a designated profile. While it is intended that the tips of the superabrasive particles align along the designated profile, some level of deviation may occur. These deviations may be a result of the design or manufacturing process of the tool. Given the wide variety of sizes of superabrasive particles that may potentially be utilized in a given tool, such deviations may be highly dependent on a particular application. Also, when referring to the designated profile, it should be noted that the term "tip" is intended to include the highest protruding point of a superabrasive particle, whether that point be an apex, an edge, or a face.

As such, in one aspect the plurality of superabrasive particles are arranged such that their tips vary from the designated profile by from about 1 micron to about 150 microns. In another aspect, the plurality of superabrasive particles are arranged such that their tips vary from the designated profile by from about 5 microns to about 100 microns. In yet another aspect, the plurality of superabrasive particles are arranged such that their tips vary from the designated profile by from about 10 microns to about 75 microns. In a further aspect, the plurality of superabrasive particles are arranged such that their tips vary from the designated profile by from about 10 microns to about 50 microns. In another aspect, the plurality of superabrasive particles are arranged such that their tips vary from the designated profile by from about 50 microns to about 150 microns. In yet another aspect, the plurality of superabrasive particles are arranged such that their tips vary from the designated profile by from about 20 microns to about 100 microns. In a further aspect, the plurality of superabrasive particles are arranged such that their tips vary from the designated profile by from about 20 microns to about 50 microns. In another aspect, the plurality of superabrasive particles are arranged such that their tips vary from the designated profile by from about 20 microns to about 40 microns. Additionally, in one aspect, the plurality of superabrasive particles are arranged such that their tips vary from the designated profile by less than about 20 microns. In another aspect the plurality of superabrasive particles are arranged such that their tips vary from the designated profile by less than about 10 microns. In yet another aspect, the plurality of superabrasive particles are arranged such that their tips vary from the designated profile by less than about 5 microns. In yet another aspect, the plurality of superabrasive particles are arranged such that their tips vary from the designated profile by less than about 1 micron. In a further aspect, a majority of the plurality of superabrasive particles are arranges such that their tips vary from the designated profile to less than about 10% of the average size of the superabrasive particles.

In another aspect, each of the plurality of superabrasive particles can be defined by a protrusion distance from an exposed surface of a binding material from which they protrude to a predetermined height. Though the predetermined height may vary between tool applications, in one aspect the predetermined height may be greater than about 20 microns. In another aspect the variation from the predetermined height may be from about 1 micron to about 20 microns. In yet another aspect the variation from the predetermined height may be from about 5 microns to about 20 microns. In a further aspect the variation from the predetermined height may be from about 10 microns to about 20 microns. Superabrasive particles may also be arranged with respect to arrangement or distribution, attitude, size, etc. Furthermore, the distribution of protrusion of the plurality of superabrasive particles is reflected in the depth that the particles cut into a CMP pad.

As such, in one specific aspect the predetermined height or protrusion distance may produce a cutting depth of less than about 20 microns when used to dress a CMP pad. In another specific aspect, the predetermined height or protrusion distance may produce a cutting depth of from about 1 micron to about 20 microns when used to dress a CMP pad. In yet another specific aspect, the predetermined height or protrusion distance may produce a cutting depth of from about 10 micron to about 20 microns when used to dress a CMP pad. It should also be noted that the leveling of superabrasive particles to a predetermined height may be dependent on superabrasive particle spacing. In other words, the farther superabrasive particles are separated, the more the impinging forces will affect each superabrasive particle. As such, patterns with increased spacing between the superabrasive particles may benefit from a smaller variation from predetermined height.

In one specific example, a plurality of cutting elements such as superabrasive particles can protrude to a predetermined height above a binding material such as, for example, a solidified organic material layer. Though any predetermined height that would be useful in an abrading or cutting tool would be considered to be within the presently claimed scope, in one specific aspect the predetermined height may produce a cutting depth of less than about 20 microns when used to abrade a workpiece. In another specific aspect, the predetermined height may produce a cutting depth of from about 1 micron to about 20 microns when used to abrade a workpiece. In yet another specific aspect, the predetermined height may produce a cutting depth of from about 10 micron to about 20 microns when used to abrade a workpiece. In yet another aspect, the predetermined height may produce a depth of up to or more than 50 or 100 microns.

As a further example, it may also be beneficial for the cutting elements to protrude from the binding material, for example, solidified organic material layer to a predetermined height or series of heights that is/are along a designated profile. Numerous configurations for designated profiles are possible, depending on the particular use of the abrading tool. In one aspect, the designated profile may be a plane. In planar profiles, the highest protruding points of the cutting elements are intended to be substantially level. It is important to point out that, though it is preferred that these points align with the designated profile, there may be some height deviation between cutting elements that occur due to limitations inherent in the manufacturing process.

In addition to planar profiles, in another aspect the designated profile has a slope. Tools having sloping surfaces may function to more evenly spread the frictional forces impinging thereon across the cutting elements, particularly for rotating tools such as disk sanders and CMP pad dressers. The greater downward force applied by higher central portions of the tool may offset the higher rotational velocity at the periphery, thus reducing the mechanical stress experienced by cutting elements in that location. As such, the slope may be continuous from a central point of the tool to a peripheral point, or the slope may be discontinuous, and thus be present on only a portion of the tool. Similarly, a given tool may have a single slope or multiple slopes. In certain aspects, the tool may slope in a direction from a central point to a peripheral point, or it may slope from a peripheral point to a central point.

Various slopes are contemplated that may provide a benefit to solidified organic material layer tools. It is not intended that the claims of the present invention be limited as to specific slopes, as a variety of slopes in numerous different tools are possible. In one aspect, however, a CMP pad dresser may benefit from an average slope of $1/1000$ from the center to the periphery.

As a variation on tools having a slope, in certain aspects the designated profile may have a curved shape. One specific example of a curved shape is a dome shape tool. Such curved profiles function in a similar manner to the sloped surfaces. Tools may include such curved profiles in order to more effectively distribute the frictional forces between all of the cutting elements, thus reducing failures of individual particles and prolonging the life of the tool.

Furthermore, in some aspects the determination of the distance that the tips of the cutting elements extend from a binder material, such as an organic binder, can also be affected by considering how much of the cutting elements extend above the binder compared to how much of the cutting elements remain submerged beneath the binder surface. In one aspect, a ratio of an amount the cutting elements protrude above the binder to an amount submerged beneath the binder is about 4 to 1. In another aspect, about $2/3$ of the cutting elements are submerged, with about $1/3$ being exposed above the binder. Other ratios are also possible, from a 20 to 1 ratio to about 0.2 to 1, inclusive of ranges therebetween.

As a non-limiting example, in one aspect a CMP pad dresser can include a support substrate, such as a rigid support substrate, and a monolayer of a plurality of superabrasive particles coupled to the support substrate, where the plurality of superabrasive particles includes a plurality of working superabrasive particles. In use the dresser can be engaged against a CMP pad and cut asperities into the CMP pad having a cutting depth of less than or equal to about 50 microns. In another aspect, the cutting depth is from about 10 microns to about 50 microns. Additionally, in one aspect the plurality of working superabrasive particles includes at least 100 working superabrasive particles, at least 300 working superabrasive particles, or at least 500 working superabrasive particles. In another aspect, the plurality of working superabrasive particles includes at least 1000 working superabrasive particles. In yet another aspect, the plurality of working superabrasive particles includes from about 1000 to about 6000 working superabrasive particles. In a further aspect, the plurality of working superabrasive particles includes from about 2000 to about 5000 working superabrasive particles. In yet another aspect, the plurality of working superabrasive particles include at least about 1000 working superabrasive particles that protrude from the rigid support substrate to distances within about 30 microns of one another.

It is noted that, in some cases, the number of working superabrasive particles can be determined by observing edge or tip wear after use in a dressing operation. As such, in one aspect a CMP pad dresser can have greater than about 300 superabrasive particles with worn tips or edges following a CMP pad dressing procedure. In another aspect, a CMP pad dresser can have greater than about 500 superabrasive particles with worn tips or edges following a CMP pad dressing procedure. In a further aspect, a CMP pad dresser can have greater than about 1000 superabrasive particles with worn tips or edges following a CMP pad dressing procedure.

In one example, superabrasive particle tips can be described in terms of the distance that each superabrasive particle protrudes from the binding material, or matrix layer. The difference in protrusion distance between the highest protruding tip and the next highest protruding tip of the monolayer of superabrasive particles is described as the protrusion difference. In one aspect, the protrusion difference can be less than or equal to about 50 microns. In another aspect, the protrusion difference can be less than or equal to about 20 microns. In a further aspect, the protrusion difference can be less than or equal to about 10 microns. It is noted that the term "protrusion difference" can also be used to describe the difference in protrusion distance between any two or more superabrasive particles.

In another aspect, and in addition to the protrusion difference between the highest two protruding tips, the difference in protrusion distance between the highest 10 protruding tips of the monolayer of superabrasive particles are within about 30 microns or less. In yet another aspect, the difference in protrusion distance between the highest 10 protruding tips of the monolayer of superabrasive particles are within about 20 microns or less.

Additionally, in some aspects the difference in protrusion distance between the highest 1% of the protruding tips of the first monolayer of superabrasive particles can be within about 80 microns or less. In other words, for the 1% of the plurality of superabrasive particles that have the highest protruding tips, the variance in protrusion distance for that 1% is less than or equal to about 80 microns. For example, the two highest protruding superabrasive particle tips protrude to within about 10 microns or less of each other, and in addition, the highest protruding 1% of superabrasive particle tips protrude to within about 80 microns or less of each other. In yet another aspect, the difference in protrusion distance between the highest 1% of the protruding tips of the monolayer of superabrasive particles are within about 60 microns or less. In yet another aspect, the difference in protrusion distance between the highest 1% of the protruding tips of the monolayer of superabrasive particles are within about 40 microns or less.

It is noted that the recited protrusion distances can include a distribution across the entire monolayer surface or a discrete area or segment of the monolayer. For example, the highest 1% of protruding tips can be located around the periphery of the monolayer. In one aspect, for example, substantially all of the asperities are cut in the CMP pad by superabrasive particles located at a peripheral location of the dresser. In another aspect, the peripheral location extends from an outer edge of the dresser inwardly toward a center point of the dresser for up to about 90% of the dresser radius. In yet another aspect, the peripheral location extends from an outer edge of the dresser inwardly toward a center point of the dresser for up to about 50% of the dresser radius. In a further aspect, the peripheral location extends from an outer edge of the dresser inwardly toward a center point of the dresser for up to about 33% of the dresser radius. Additionally, in some aspects, substantially all of the superabrasive particles are located at a peripheral location of the dresser. In other aspects, substantially all of the superabrasive particles are arranged in uniform predetermined pattern at a peripheral location of the dresser.

In another example, discrete regions of leveled superabrasive particle tips can be located within a larger area of superabrasive particles having a lower protrusion distance than the leveled portion. It is also contemplated that the monolayer can include multiple regions or segments of superabrasive particles that are leveled as described, within a larger area of superabrasive particles having a lower protrusion distance.

Thus, the relative leveling of the monolayer of superabrasive particles can greatly affect the morphology and distribution of asperities cut into the CMP pad by the dresser. For example, in one aspect, the monolayer is leveled such that rotating the dresser against the CMP cuts asperities having a maximum cutting depth of about 80 microns. In another aspect, the monolayer is leveled such that rotating the dresser against the CMP cuts asperities having a maximum cutting depth of about 60 microns. In yet another aspect, the monolayer is leveled such that rotating the dresser against the CMP cuts asperities having a maximum cutting depth of about 40 microns. By forming pointed asperities, the contact pressure between the work piece and the CMP pad is increased, thus improving the polishing characteristics of the pad. As these pointed regions begin to flatten, the contact pressure begins to decrease, and slurry located therebetween is less effectively pressed against the work piece. In some aspects it can be beneficial for the contact area between the pad and the wafer to be less than or equal to about 1% of the total wafer surface area facing the pad. In other aspects, it can be beneficial for the contact area between the pad and the wafer to be less than or equal to about 0.1% of the total wafer surface area facing the pad. This small contact area is due to the wafer being perched on the contact points of the asperities. During the polishing process, the sharp tips of the asperities become worn, thus increasing the contact area and decreasing the contact pressure to a point whereby the slurry abrasives do not effectively abrade the wafer. At this point the removal rate of material from the wafer drops, and the pad needs to be redressed to resharpen the asperities.

Additionally, the load placed on the CMP pad by the dresser can affect the morphology of the spacers, such as, in some cases, the asperity depth. The load can be adjusted for a given dresser to adjust penetration depth. In one aspect, for example, the load can be from about 0.1 Kg to about 60 Kg. In other aspects, the load can be from about 2 Kg to about 20 Kg. In further aspects, the load may be from about 6 Kg to about 12 Kg. In some aspects the load may be Kg/m2. For example, in one aspect an 11.5 Kg load can allow a material removal rate from the wafer of about 200 microns per hour for Cu layers. In a related example, an 11.5 Kg load can allow a material removal rate from the wafer of about 100 microns per hour for oxides. In many cases, a lower load can be used in order to minimize the superabrasive particle damage (e.g., less than or equal to about 2 Kg).

Furthermore, leveling of the tips of the superabrasive particles in the monolayer allows differing amounts of superabrasive particles to actually cut asperities into the pad. In one aspect, for example, the tips are leveled such that at least 100 tips of the plurality of superabrasive particles cut asperities into the CMP pad as the dresser is rotated. In another aspect, the tips are leveled such that at least 50 tips of the plurality of superabrasive particles cut asperities into the CMP pad as the dresser is rotated. In a further aspect, the tips are leveled such that at least 25 tips of the plurality of superabrasive particles cut asperities into the CMP pad as the dresser is rotated.

Additionally, various methods can be utilized to measure superabrasive particle tip height to determine the difference in protrusion distance between tips. As such, any method for making such a determination is considered to be within the present scope. It should be noted that for the purposes of the present disclosure, the term "protrusion" refers to the height of a particle relative to some reference point. Techniques for such measurements can include direct measurements of the tip heights relative to a reference point such as, for example, the highest particle tip, a surface of a rigid support, the bottom surface of the matrix, etc. Measurements of particle height from the surface of the matrix material can be problematic, however, due to the irregular nature of such materials due to wicking around the superabrasive particles. In those cases whereby the matrix material is uniform, such a surface may be used to determine particle height. Additionally, a relative protrusion or height difference between two particles would be the difference in the heights between these particles measured from a common reference point. Furthermore, in some cases the superabrasive particles may lie along a slope, curvature, or some other arrangement that is not parallel to the underlying support, such as, for example, a metal support layer. In these cases, the protrusion height would be normalized against the slope, curvature, or other arrangement so that the relative protrusion height difference between particles can be measured in the absence of the slope, curvature, etc. It should be noted that superabrasive particle tip height leveling can, in some cases, be independent from the positioning or patterning of the superabrasive particles across the surface of the dresser.

One example of a direct measurement technique can include an optical scanning process to evaluate superabrasive particle tip positions. In one such process, an optical scanner can scan the surface of the CMP pad dresser to determine the height of the superabrasive particle tips relative to a fixed point. For example, the scanner can scan downward in space toward the dresser until the highest tip is located. The highest tip can then be set to the reference point, and the scanner can continue scanning in a direction toward the dresser measuring the distance from the reference point to each superabrasive particle tip across the surface of the dresser. Accordingly, the difference in protrusion distance between all of the superabrasive particles across the dresser can be directly measured.

Furthermore, measurement techniques can also include indirect measurements, such as, for example, applying the diamond monolayer to a deformable substrate that deforms relative to the protrusion distance of the particle tips. The diamond monolayer can be pressed into the deformable substrate and/or moved across the deformable substrate to form a scratch pattern therein. Tip height can thus be extrapolated from such indirect measurements.

Numerous configurations for designated profiles are possible depending on the particular use of the abrading tool, and all such designated profiles are considered to be within the present scope. In one aspect, for example, the designated profile can be a plane. In planar profiles, the highest protruding points of the superabrasive particles are intended to be substantially level in the traditional sense. It is important to point out that, though it is preferred that these points align with the designated profile, there may be some height deviation between superabrasive particles that occur due to limitations inherent in the manufacturing process.

In addition to planar profiles, in another aspect of the present invention the designated profile has a slope. Tools having sloping surfaces may function to more evenly spread the frictional forces impinging thereon across the superabrasive particles, particularly for rotating tools such as disk sanders and CMP pad dressers. The greater downward force applied by higher central portions of the tool may offset the higher rotational velocity at the periphery, thus reducing the mechanical stress experienced by superabrasive particles in that location. As such, the slope may be continuous from a central point of the tool to a peripheral point, or the slope may be discontinuous, and thus be present on only a portion of the tool. Similarly, a given tool may have a single slope or multiple slopes. In certain aspects, the tool may slope in a direction from a central point to a peripheral point, or it may slope from a peripheral point to a central point. Various slopes are contemplated that may provide a benefit to solidified organic material layer tools. It is not intended that the claims of the present invention be limited as to specific slopes, as a variety of slopes in numerous different tools are possible. In one aspect, however, a CMP pad dresser may benefit from an average slope of 1/1000 from the center to the periphery.

Furthermore, in certain aspects the designated profile may have a curved shape. One specific example of a curved shape is a dome shape CMP pad dresser. Such curved profiles function in a similar manner to the sloped surfaces. CMP pad dressers may include such curved profiles in order to more effectively distribute the frictional forces between all of the superabrasive particles, thus reducing failures of individual particles and prolonging the life of the dresser. Also, CMP pad dressers can have designated profiles that combine any of a plane, a slope, a curved shape, a dome shape, and the like, into a variety of complex profiles.

In another aspect of the present disclosure, a CMP pad dresser can include a support substrate, such as a rigid support substrate, and a monolayer of a plurality of superabrasive particles coupled to the support substrate, where each superabrasive particle in the monolayer extends away from the support substrate to a protrusion distance, and where the difference in protrusion distance between the highest protruding tip and the second highest protruding tip of the monolayer of superabrasive particles is less than or equal to about 50 microns. Additionally, the difference in protrusion distance between the highest 1% of the protruding tips of the monolayer of superabrasive particles are within about 80 microns or less. In another aspect, the difference in protrusion distance between the highest protruding tip and the second highest protruding tip is less than or equal to about 10 microns. In yet another aspect, the difference in protrusion distance between the highest protruding tip and the second highest protruding tip is less than or equal to about 10 microns. In a further aspect, the difference in protrusion distance between the highest protruding tip and the $10^{th}$ highest protruding tip is less than or equal to about 20 microns. In yet another aspect, the difference in protrusion distance between the highest protruding tip and the $100^{th}$ highest protruding tip is less than or equal to about 40 microns.

In another aspect of the present disclosure, a CMP pad dresser is provided including a support substrate and a plurality of superabrasive particles secured to the support substrate and positioned to engage and dress a CMP pad, where the plurality of superabrasive particles cut to depths of less than 50 microns into a CMP pad during a dressing procedure.

In a further aspect, a method of dressing a CMP pad is provided. Such a method can include applying a CMP pad dresser to a CMP pad, and moving at least one of the CMP pad or the CMP pad dresser with respect to one another to cut asperities into the CMP pad having a cutting depth of from about 10 microns to about 50 microns. As one non-limiting example, an exemplary CMP pad can include a support substrate and a monolayer of a plurality of superabrasive particles coupled to the support substrate, where the plurality of superabrasive particles includes a plurality of working superabrasive particles.

In one exemplary aspect, as is shown in FIG. 1, a CMP pad dresser 100 includes a monolayer of a plurality of superabrasive particles 102 coupled to a support substrate 104 with, for example, a binding material 105. Each superabrasive particle in the monolayer protrudes to a protrusion distance from the support substrate. The difference in protrusion distance 106 between the highest protruding tip 108 and the next highest protruding tip 110 of the monolayer of superabrasive particles is described as the protrusion difference. In one aspect, the protrusion difference can be less than or equal to about 50 microns. In another aspect, the protrusion difference can be less than or equal to about 20 microns. In a further aspect, the protrusion difference can be less than or equal to about 10 microns. It is noted that the term "protrusion difference" can also be used to describe the difference in protraction distance between any two or more superabrasive particles.

A variety of materials are contemplated for use as superabrasive particles. Any superabrasive known that can be utilized in a CMP pad dresser should be considered to be within the present scope. Non-limiting examples of such materials include diamond materials, nitride materials, ceramics, and the like. In one aspect, the superabrasive particles include diamond materials. Such diamond materials can include natural or synthetic diamond, single crystal, polycrystalline, and the like. In another aspect, the superabrasive particles include cubic boron nitride materials.

It is intended that the scope of the present disclosure include superabrasive particles of all conceivable sizes that would be useful in dressing a CMP pad. Aspects of the present disclosure, however, specifically allow the retention of superabrasive particles in a CMP pad dresser of sizes that have not previously been feasible for use in metal tools made using traditional techniques with particles exposed and arranged in a pattern. In one aspect, superabrasive particles may range in size from about 30 microns to about 250 microns. In another aspect, superabrasive particles may range in size from about 100 microns to about 200 microns. In yet another aspect, superabrasive particles can range from 100 microns to 150 microns. Additionally, various diamond particles sizes can be used, including mesh sizes such as 10/20, 30/40, 80/90, 90/100, 100/120, 120/140, 140/170, 170/200, 200/230, 230/270, 270/325, and 325/400.

Additionally, the plurality the superabrasive particles can be oriented so as to affect dressing performance of a CMP pad. Orienting the superabrasive particles in a specific attitude in relation to the CMP pad to be dressed creates different asperities in the pad surface, thus altering the performance of the CMP pad. Different asperities retain slurry in different manners and thus polish a workpiece differently according to asperity depth, width, density, etc. The superabrasive particles of a CMP pad dresser can be oriented according to the desired polishing characteristics of the CMP pad. For example, if the superabrasive particles predominantly have an apex oriented towards the CMP pad, the asperities of the pad will be narrow and deep. The advantages of narrow and deep asperities are that the pad can better retain the polishing slurry, and thus the polishing rate of the wafer increases. However, the increased polishing rate may also increase the wear rate of the superabrasive particles. As such, wear rate may vary depending on the attitude of the superabrasive particles, and therefore, the orientation of each superabrasive particle may be considered when designing a device with desired performance characteristics. Generally speaking, superabrasive particle attitudes that provide higher dressing rates (i.e. deeper penetration into a pad) also wear particles out at a higher rate.

In contrast, if the superabrasive particles are oriented with a face towards the pad, the resulting asperities may polish at a lower rate. The face of the particle is generally thought to be more durable, but does not typically cut deep and narrow asperities in the pad, but rather asperities that are shallow and broad. Therefore the face portion of a particle will dress a CMP pad at a reduced rate compared to the apex portion of a particle, but the superabrasive particle will wear at a much lower rate.

The edge portions of a superabrasive particle have dressing and wear characteristics that are between those of the face and apex portions. It has been thought that if the edge portion is utilized to dress a CMP pad, the asperities are not as deep or narrow as those dressed with an apex portion, but may provide asperities having desirable intermediate characteristics. Further, the edge portion of the particle does not wear at such a high rate as that of an apex.

In one aspect, the plurality of superabrasive particles are substantially all configured in an attitude having either an apex portion or an edge portion oriented toward a pad to be dressed. In another aspect, the plurality of superabrasive particles are substantially all configured in an attitude having either an edge portion or a face portion oriented toward a pad to be dressed. In yet another aspect, the plurality of superabrasive particles can be configured in an attitude having a sharp portion oriented towards a pad to be dressed. In a further aspect, the plurality of superabrasive particles can be configured in an attitude having an apex portion oriented towards a pad to be dressed.

A CMP pad dresser having a substantially leveled tip arrangements can have a low scratch rate because superabrasive particles are less likely to pull out of the matrix layer due to their more uniform protrusion distribution compared to traditional dressers. Additionally, the more uniform protrusion distributions of such a dressers allows the conditioning of CMP pads in such a manner as to facilitate good polishing rates while at the same time extending the effective working life of the dresser. These benefits can be affected by, for example, uniform asperity spacing and size distribution in the CMP pad.

CMP pad dressers having substantially leveled or leveled superabrasive particle tips can be made using various manufacturing techniques, and any such technique is considered to be within the present scope. The following description provides a few non-limiting descriptions of such exemplary processes.

In one aspect, for example, a CMP pad dresser can be made using a brazing process, and as such would generally include a support substrate and a plurality of superabrasive particles coupled to the support substrate by a metal or metal alloy braze material. As has been described, traditional brazing techniques create warpage in the dresser as the braze material cools. As such, superabrasive particle tips that were leveled prior to brazing are substantially misaligned in the manufactured dresser. Therefore, steps to minimize or eliminate the warpage must be taken when using a braze process in order to maintain tip leveling. Various techniques to minimize or eliminate warpage are contemplated, and any such technique is considered to be within the present scope.

As one general example, a CMP pad dresser can be made in at least a two stage process, where the first stage is performed in a manner that minimizes perturbations of the leveled tips in a process that would normally significantly move the superabrasive tips out of a leveled arrangement, such as, for example, by brazing. The second stage of the process can further enhance the leveling of superabrasive particle tips across the CMP pad dresser. Other examples may include utilizing lower temperature alloys, using slow temperature ramping in heating and/or cooling of the support substrate, using additional mechanical support to firmly hold the support substrate from moving when warpage occurs, and the like.

Warpage can also be minimized or eliminated through the structural design of the dresser. For example, in one aspect a CMP pad dresser can include a first monolayer of superabrasive particles disposed on one side of a metal support layer and a second monolayer of superabrasive particles disposed on the metal support layer on an opposite side from the first monolayer. The superabrasive particles of the second monolayer are positioned to have substantially the same distribution as the superabrasive particles of the first monolayer. A rigid support is coupled to the second monolayer of superabrasive particles opposite the first monolayer to provide support to the dresser.

Figure 2:
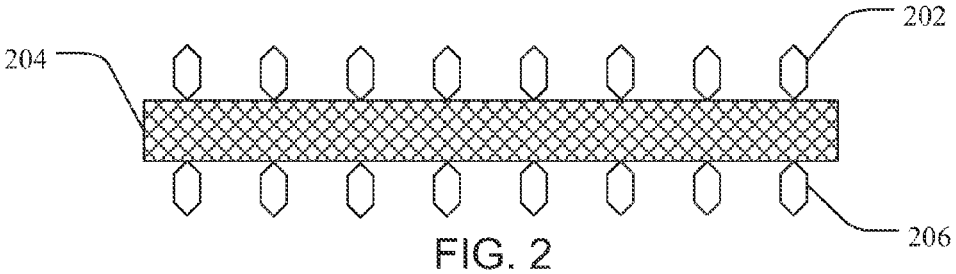
FIG. 2 is a schematic side view of a CMP pad dresser in accordance with an embodiment of the present disclosure.

As is shown in FIG. 2, for example, a first monolayer of superabrasive particles 202 is arranged on a surface of a support substrate 204. A second monolayer of superabrasive particles 206 is arranged on the support substrate 204 on a side that is opposite to the first monolayer. As is discussed further below, in some cases the first and second monolayers of superabrasive particles can be arranged such that corresponding superabrasive particles across the support layer are in substantial alignment, as is shown in FIG. 2. In other cases, the superabrasive particles of the first and second monolayers can be arranged in a substantially similar distribution, but may or may not be substantially aligned with one another across the support substrate.

The disposition of a monolayer of superabrasive particles on each side of the support substrate thus moderates the thermal shrinkage from the brazing temperature that would otherwise buckle a distribution of superabrasive particles arranged on just one side. By applying a monolayer to each side of the support substrate, warping forces such as thermal movement and pressure can be equalized or substantially equalized from both sides. As such, the warpage of the support substrate can be minimized. In other words, the forces responsible for warping are applied substantially equally to each side of the support substrate and can thus at least partially cancel one another out, thus minimizing warpage that can otherwise occur. In some aspects, the superabrasive particles making up the monolayers on each side of the support substrate can have matching configurations, patterns, or orientations to one another. In this way there can be a substantially matching spatial arrangement of superabrasive particles on each side of the support substrate. In another aspect, the configurations, patterns, or orientations can be different or varied from one another, or may be partially matching. In yet another aspect, the patterned placement of the superabrasive particles on one side of the support substrate can be substantially aligned with the pattern of superabrasive particles on the other side of the support substrate so that particle locations match one another. In some aspects, there can be a direct correspondence between the spatial positioning of superabrasive particles on one side of the support substrate and the spatial positioning of superabrasive particles on the other side of the metal support substrate. In another aspect, the patterns of superabrasive particles may match or substantially match one another, but may be offset on opposite sides of the support substrate so that particle locations do not match one another.

Accordingly, minimizing the warpage of the support substrate can maintain a greater degree of leveling of superabrasive particle tips in the finished tool. When heat and/or pressure are used to make a superabrasive tool, warpage of the support substrate can cause great variations in tip height level, even for those particles that were leveled prior to heating and/or applying pressure. In one aspect, distributing the warpage forces equally or substantially equally on both sides of a support substrate through the arrangement of the superabrasive particles can effectively cancel forces on opposing sides and thus greatly reduce the degree of warping occurring in the support substrate, thus also minimizing the relative height movement of the superabrasive particles relative to one another. In other aspects, CMP pad dressers can be made using processes that do not utilized high pressure and/or high temperature.

The support substrate can be any material capable of supporting the diamond monolayer during tool formation. Such materials can include, without limitation, metal materials, metal alloy materials, braze alloy materials, ceramic materials, composites, and the like.

In one aspect, the superabrasive particles can be arranged into a predetermined pattern. Such a pattern can be a uniformly distributed pattern or a non-uniformly distributed pattern. Additionally, a variety of techniques are contemplated to facilitate the arrangement of superabrasive particles into a predetermined pattern. Predetermined is understood to mean a non-random pattern that has been determined prior to arranging the superabrasive particles. In one aspect, a predetermined pattern can also apply to a predetermined spacing between particles. Non-limiting examples of such techniques include arrangement by a template, arrangement using spots of adhesives, arrangement on a first substrate followed by a pattern specific transfer from the first substrate to the support substrate, and the like, including combinations thereof. The superabrasive particles from either of the monolayers can be temporarily held in position in the predetermined pattern using a variety of techniques, including, without limitation, adhesives, dimpled locations on the metal support matrix, a supporting compound such as, for example, a wax, and the like, including combinations thereof. In one specific aspect, the superabrasive particles can be temporarily coupled to the support substrate using an adhesive that then volatilizes away and is eliminated during construction of the dresser.

In one aspect, the predetermined pattern can be a uniformly distributed grid. In another aspect, the predetermined pattern can be an annular configuration having a central region devoid of superabrasive particles. In one specific aspect, the annular configuration can include an annular ring. In another specific aspect, the annular configuration can include a portion of an annular ring. In yet another aspect, an annular configuration can include one or more concentric annular rings nested inside one another. In other aspects, the monolayer distribution can be discrete radial regions, spiral regions, and the like.

Figure 3:
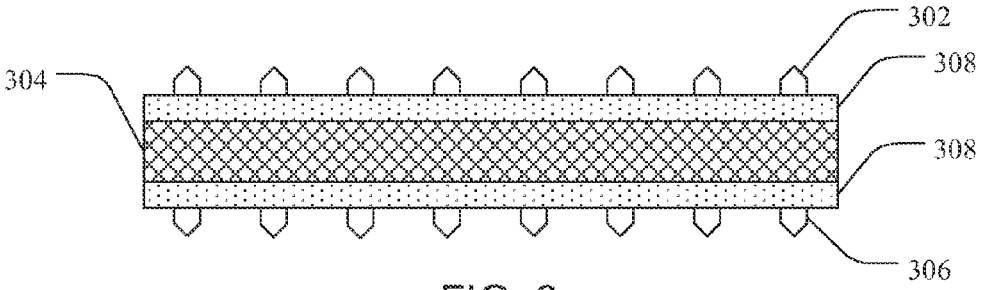
FIG. 3 is a schematic side view of a CMP pad dresser in accordance with an embodiment of the present disclosure.

In another aspect, as is shown in FIG. 3, a first monolayer of superabrasive particles 302 is arranged on a surface of a support substrate 304. A second monolayer of superabrasive particles 306 is arranged on the support substrate 304 on a side that is opposite to the first monolayer. A bonding material 308 secures the first monolayer and the second monolayer to the support substrate 34. The bonding material can be any material capable of securing the first and second monolayer to the support substrate. In some aspect, the bonding material can be the same for securing the first monolayer and the second monolayer, while in other aspects the bonding material can be different for securing the first monolayer and the second monolayer.

It is noted that the various descriptions of materials, attachment techniques, and the like, can be generally applicable to any CMP pad dresser design to which such materials, techniques, and the like are applicable. For example, a material that can be used to secure a superabrasive particle to a substrate can be used in both dual monolayer and single monolayer dresser designs.

Accordingly, the bonding material can be any material capable of securing superabrasive particles therein. Non-limiting examples of bonding materials include metal brazes, metal braze alloys, organic matrix materials, sintered materials, electroplated materials, and the like, including combinations thereof.

In one aspect, for example, the superabrasive particles can be brazed to the support substrate, and thus the bonding material can be a metal braze or metal braze alloy. Metal brazing techniques are known in the art. A green braze material can be applied to the support substrate on or around the superabrasive particles. The metal braze can be applied in any known configuration, including braze sheets, powders, pastes, sprays, and the like, including combinations thereof. Once applied to the support substrate, the braze can be heated and melted to coat at least a portion of the support substrate and to bond the superabrasive particles. The heating temperature can vary depending on the braze material used, but in one aspect can be from about 700° C. to about 1200° C.

In one non-limiting example, the superabrasive particles can be bonded to the support substrate by brazing with a nickel-based alloy containing chromium. In another example, the brazing can include pressing the superabrasive particles with a flat ceramic material that cannot be bonded to the braze in order to level the superabrasive particle tips. Various braze alloys are contemplated, including non-limiting examples such as $BNi_2$, $BNi_7$, and the like.

Additionally, in one aspect superabrasive particles can be coupled to the support substrate by an electrodeposition process, and thus the bonding material can be an electrodeposited metal material. As an example of a suitable method for positioning and retaining abrasive materials prior to and during the electrodeposition process, a mold can be used that includes an insulating material that can effectively prevent the accumulation of electrodeposited material on the molding surface. Superabrasive particles can be held on the molding surface of the mold during electro deposition. As such, the accumulation of electrodeposited material can be prevented from occurring on the particle tips and the working surface of the pad conditioner substrate. Such techniques are described in U.S. patent application Ser. No. 11/292,938, filed Dec. 2, 2005, which is hereby incorporated herein by reference.

In another aspect, the superabrasive particles can be bonded to the support substrate by sintering, and thus the bonding material can include a sintering material. For example, the bonding of the superabrasive particles to the support substrate can include disposing a sintering compound on the support substrate in contact with the plurality of superabrasive particles, and sintering the sintering compound to bond the superabrasive particles to the support substrate. Suitable sintering methods will be readily appreciated by one of ordinary skill in the art having possession of this disclosure. Basically, a sintering compound is applied around the superabrasive particles and in contact with the support substrate. The sintering compound can be any known sintering material that can be used to secure superabrasive particles to a substrate. Non-limiting examples of such materials can include metal and metal alloy powders, ceramic powders, and the like. One specific non-limiting example of a sintering compound is cobalt powder.

Once the sintering compound has been applied around the superabrasive particles and to the support substrate, heat and in some cases pressure can be applied to cause sintering to occur. In some aspects, a braze or braze alloy can be infiltrated into the sintering compound during bonding to further strengthen the bonding material matrix.

In yet another aspect, sintering can be used to sinter the plurality of superabrasive particles into a CMP pad dresser, where the support substrate is the sintering material. In this case, the above recited procedure can be repeated without the use of a support substrate.

In another aspect, heat and pressure can be applied to bond the plurality of superabrasive particles directly into the support substrate. Thus, upon the application of heat and pressure, the support substrate can be softened or partially melted. The superabrasive particles are then pressed into the support substrate. A planar leveling surface can be used to apply pressure to the monolayer of superabrasive particles to thus maintain the level nature of the superabrasive particle tips as the superabrasive particles are pressed into the support substrate. Pressure can be maintained upon the support substrate and superabrasive particles until cooled, thus minimizing warping.

Figure 4:
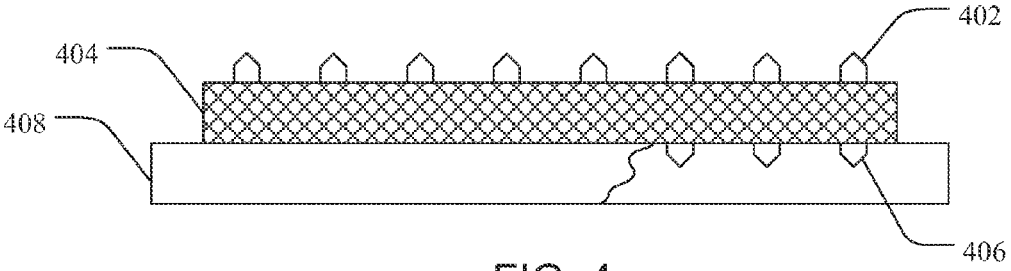
FIG. 4 is a schematic side view of a CMP pad dresser in accordance with an embodiment of the present disclosure.

In yet another aspect, as is shown in FIG. 4, a dual monolayer CMP pad dresser can include a first monolayer of superabrasive particles 402 and a second monolayer of superabrasive particles 406 coupled to a support substrate 404. The superabrasive particles can be coupled to the support substrate directly or via a bonding material. The second monolayer of superabrasive particles 406 is coupled to a second support substrate 408. A portion of the second support substrate is shown removed in FIG. 4 to expose the second monolayer. The second support substrate 408 can facilitate handling and use of the CMP pad dresser. By bonding the superabrasive particles of the second monolayer to the second support substrate, the first monolayer of superabrasive particles remains exposed for CMP pad conditioning operations.

The second support substrate can be made from any material compatible with the abrading or dressing process. Such materials can include polymeric materials, metal materials, ceramic materials, glasses, composites, and the like. In one aspect, the second support substrate can be a polymeric material and the second monolayer of superabrasive particles can be embedded therein using heat, pressure, adhesives, etc. In some aspects, the second support substrate can be a non-polymeric material such as a metal layer. In such cases, the superabrasive particles can be bonded to the second support substrate by adhesive attachment, soldering, brazing, electroplating, and the like. For brazing techniques, care can be taken to minimize or eliminate warpage in the substrate during the heating and cooling process. In another aspect, one or more magnetic elements can be placed into the second support substrate to attract and hold the CMP pad dresser in place, thus forming a temporary attachment. An optional locking mechanism can be utilized to further immobilize the CMP pad dresser to the second support substrate during use. In some aspects the second support substrate can include surface features to hold the dresser in place during rotational movement against a CMP pad. The second support substrate can have approximately the same diameter as the metal support layer, a larger diameter than the metal support layer, or, in some cases, a smaller diameter than the metal support layer.

In another aspect, a CMP pad dresser can be comprised of a plurality of dressing segments having a plurality of leveled superabrasive particles tips, where the plurality of dressing segments are held in place by a rigid support or support substrate. Such a design allows a plurality of smaller dressing segments to be manufactured having precisely leveled tips. Smaller diameter support layers in these dressing segments can be made by processes involving heat and/or pressure with less warpage due to their smaller size. For example, a 4 inch diameter metal disc can exhibit greater warping due to brazing as compared to a 0.5 inch diameter metal disc. Thus thermal distortion and particle floating problems are decreased. A plurality of such dressing segments can then be coupled to a larger diameter support substrate by processes that do not introduce significant warpage, such as bonding in an organic material. Such dressing segments can have one or more layer(s) of superabrasive particles coupled to a support layer. In one aspect, a segment can have a single layer of superabrasive particles coupled to a support layer. In another aspect, a segment can have a layer of superabrasive particles coupled to each side of a support layer, as has been described herein. Thus, this process allows the manufacture of CMP pad dressers that can have precise tip protrusion tolerances. Additionally, in one aspect, each dressing segment can have at least three superabrasive particles that protrude to the greatest extent. If the three highest protruding superabrasive particles on every dressing segment are leveled across the entire support substrate, a CMP pad dresser is made having very precise tip leveling across the entire surface. If, for example, ten dressing segments are used to make the CMP pad dresser, then the highest protruding thirty superabrasive particles in the tool will have effectively the same protrusion distance and be substantially leveled. Various additional details regarding dressing segments are detailed in U.S. patent application Ser. No. 13/034,213, filed Feb. 24, 2011, which is hereby incorporated herein by reference.

Various organic materials are contemplated for use as a support substrate, and/or to secure a second monolayer of superabrasive particles and/or the dressing segments to the support substrate. Examples of suitable organic matrix materials include, without limitation, amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof. In one specific aspect, the organic material can be an epoxy resin. In another aspect, the organic material can be a polyimide resin. In yet another aspect, the organic material can be a polyurethane resin.

Additionally, so-called "reverse casting" methods can be used to accurately orient and attach the dressing segments to the support substrate. Such methods can include initially securing the plurality of dressing segments to a substrate using a "mask" material. The portions of the dressing segments protruding from the mask material can then be attached to the rigid support using the methods discussed herein, after which (or during which), the masking material can be removed.

When an organic material is utilized, methods of curing the organic material can be a variety of processes known to one skilled in the art that cause a phase transition in the organic material from at least a pliable state to at least a rigid state. Curing can occur, without limitation, by exposing the organic material to energy in the form of heat, electromagnetic radiation, such as ultraviolet, infrared, and microwave radiation, particle bombardment, such as an electron beam, organic catalysts, inorganic catalysts, or any other curing method known to one skilled in the art.

In one aspect of the present invention, the organic material can be a thermoplastic material. Thermoplastic materials can be reversibly hardened and softened by cooling and heating respectively. In another aspect, the organic material layer may be a thermosetting material. Thermosetting materials cannot be reversibly hardened and softened as with the thermoplastic materials. In other words, once curing has occurred, the process can be essentially irreversible, if desired.

As a more detailed list of what is described above, organic materials that may be useful in embodiments of the present invention include, but are not limited to: amino resins including alkylated urea-formaldehyde resins, melamine-formaldehyde resins, and alkylated benzoguanamine-formaldehyde resins; acrylate resins including vinyl acrylates, acrylated epoxies, acrylated urethanes, acrylated polyesters, acrylated acrylics, acrylated polyethers, vinyl ethers, acrylated oils, acrylated silicons, and associated methacrylates; alkyd resins such as urethane alkyd resins; polyester resins; polyamide resins; polyimide resins; reactive urethane resins; polyurethane resins; phenolic resins such as resole and novolac resins; phenolic/latex resins; epoxy resins such as bisphenol epoxy resins; isocyanate resins; isocyanurate resins; polysiloxane resins including alkylalkoxysilane resins; reactive vinyl resins; resins marketed under the Bakelite™ trade name, including polyethylene resins, polypropylene resins, epoxy resins, phenolic resins, polystyrene resins, phenoxy resins, perylene resins, polysulfone resins, ethylene copolymer resins, acrylonitrile-butadiene-styrene (ABS) resins, acrylic resins, and vinyl resins; acrylic resins; polycarbonate resins; and mixtures and combinations thereof. In one aspect of the present invention, the organic material may be an epoxy resin. In another aspect, the organic material may be a polyimide resin. In yet another aspect, the organic material may be a polyurethane resin.

Numerous additives may be included in the organic material to facilitate its use. For example, additional cross-linking agents and fillers may be used to improve the cured characteristics of the organic material layer. Additionally, solvents may be utilized to alter the characteristics of the organic material in the uncured state. Also, a reinforcing material may be disposed within at least a portion of the solidified organic material layer. Such reinforcing material may function to increase the strength of the organic material layer, and thus further improve the retention of the individual abrasive segments. In one aspect, the reinforcing material may include ceramics, metals, or combinations thereof. Examples of ceramics include alumina, aluminum carbide, silica, silicon carbide, zirconia, zirconium carbide, and mixtures thereof.

Additionally, in one aspect a coupling agent or an organometallic compound may be coated onto the surface of a superabrasive material to facilitate the retention of the superabrasive particles in the organic material via chemical bonding. A wide variety of organic and organometallic compounds is known to those of ordinary skill in the art and may be used. Organometallic coupling agents can form chemicals bonds between the superabrasive materials and the organic material, thus increasing the retention of the superabrasive materials therein. In this way, the organometallic coupling agent can serve as a bridge to form bonds between the organic material and the surface of the superabrasive material. In one aspect of the present invention, the organometallic coupling agent can be a titanate, zirconate, silane, or mixture thereof. The amount of organometallic coupling agent used can depend upon the coupling agent and on the surface area of the superabrasive material. Oftentimes, 0.05% to 10% by weight of the organic material layer can be sufficient.

Specific non-limiting examples of silanes suitable for use in the present invention include: 3-glycidoxypropyltrimethoxy silane (available from Dow Corning as Z-6040); γ-methacryloxy propyltrimethoxy silane (available from Union Carbide Chemicals Company as A-174); β-(3,4-epoxycyclohexyl)ethyltrimethoxy silane, γ-aminopropyltriethoxy silane, N-(β-aminoethyl)-γ-aminopropylmethyldimethoxy silane (available from Union Carbide, Shin-etsu Kagaku Kogyo K.K., etc.). Specific non-limiting examples of titanate coupling agents include: isopropyltriisostearoyl titanate, di(cumylphenylate)oxyacetate titanate, 4-aminobenzenesulfonyldodecylbenzenesulfonyl titanate, tetraoctylbis(ditridecylphosphite) titanate, isopropyltri(N-ethylamino-ethylamino) titanate (available from Kenrich Petrochemicals. Inc.), neoalkyoxy titanates such as LICA-01, LICA-09, LICA-28, LICA-44 and LICA-97 (also available from Kenrich), and the like. Specific non-limiting examples of aluminum coupling agents include acetoalkoxy aluminum diisopropylate (available from Ajinomoto K.K.), and the like. Specific non-limiting examples of zirconate coupling agents include: neoalkoxy zirconates, LZ-01, LZ-09, LZ-12, LZ-38, LZ-44, LZ-97 (all available from Kenrich Petrochemicals, Inc.), and the like. Other known organometallic coupling agents, e.g., thiolate based compounds, can be used in the present invention and are considered within the scope of the present invention.

In other aspects of the present disclosure, superabrasive particle tips can be leveled by reducing the protrusions of particles that are outside of the desired tolerance range. Once such particles are identified, various techniques can be utilized to reduce such protrusions. In one aspect, for example, mechanical abrasion of the dresser can reduce the protruding particles. In another aspect, a vibration tool can be used to individually break such particles. In yet another aspect, a laser such as a Nd:YAG laser can be used to disrupt such particles.

In yet a further aspect of the present disclosure, a CMP pad dresser can include a plurality of superabrasive particles arranged as a working surface, where the difference in protrusion distance between the highest protruding tip and the second highest protruding tip of the first monolayer of superabrasive particles is less than or equal to about 20 microns, and where the difference in protrusion distance between the highest 1% of the protruding tips of the first monolayer of superabrasive particles, excluding the highest protruding tip, are within about 80 microns.

In another aspect, a CMP pad dresser can include a plurality of superabrasive particles arranged as a working surface, where the difference in protrusion distance between the highest protruding tip and the second highest protruding tip is less than or equal to about 10 microns, the difference in protrusion distance between the highest protruding tip and the $10^{th}$ highest protruding tip is less than or equal to about 20 microns, the difference in protrusion distance between the highest protruding tip and the $100^{th}$ highest protruding tip is less than or equal to about 40 microns, and the highest protruding tip has a protrusion distance of greater than or equal to about 50 microns.

It is noted that, while the above disclosure refers primarily to CMP pad dressers, other precision grinding and/or abrading tools are considered to be within the present scope. As such, the techniques and teaching disclosed herein can additionally be applied to such tools.

Additionally, it is noted that traditional CMP processing techniques, including pad dressing, has limited the critical dimension of integrated circuits. The presently disclosed CMP dressing devices and techniques can, however, allows processing of wafers having integrated circuit critical dimensions of less than or equal to 45 nm, 32 nm, 28 nm, 22 nm, or less.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A CMP pad dresser, comprising:

a rigid support substrate; and a monolayer of a plurality of superabrasive particles coupled to the support substrate, wherein each superabrasive particle in the monolayer extends away from the support substrate to a protrusion distance, wherein a tip of each of the plurality of superabrasive particles aligns along a designated profile with a tip variation of from about 5 microns to about 100 microns, and wherein the difference in protrusion distance between the highest protruding tip and the second highest protruding tip of the monolayer of superabrasive particles is less than or equal to about 50 microns, and the difference in protrusion distance between the highest 1% of the protruding tips of the monolayer of superabrasive particles are within about 80 microns or less.

2. The dresser of claim 1, wherein the difference in protrusion distance between the highest protruding tip and the second highest protruding tip is less than or equal to about 10 microns.

3. The dresser of claim 1, wherein the difference in protrusion distance between the highest protruding tip and the second highest protruding tip is less than about 10 microns.

4. The dresser of claim 1, wherein the difference in protrusion distance between the highest protruding tip and the $10^{th}$ highest protruding tip is less than or equal to about 20 microns.

5. The dresser of claim 1, wherein the difference in protrusion distance between the highest protruding tip and the $100^{th}$ highest protruding tip is less than or equal to about 40 microns.

6. The dresser of claim 1, wherein the plurality of superabrasive particles includes a plurality of working superabrasive particles, such that rotating the dresser against a CMP pad cuts asperities into the CMP pad having a cutting depth of less than or equal to about 50 microns.

7. The dresser of claim 6, wherein the cutting depth is from about 10 microns to about 50 microns.

8. The dresser of claim 6, wherein the plurality of working superabrasive particles includes at least 100 working superabrasive particles.

9. The dresser of claim 6, wherein the plurality of working superabrasive particles includes at least 1000 working superabrasive particles.

10. The dresser of claim 6, wherein the plurality of working superabrasive particles includes from about 1000 to about 6000 working superabrasive particles.

11. The dresser of claim 6, wherein the plurality of working superabrasive particles includes from about 2000 to about 5000 working superabrasive particles.

12. The dresser of claim 6, wherein the plurality of working superabrasive particles include at least about 1000 working superabrasive particles that protrude from the rigid support substrate to distances within about 30 microns of one another.

13. The dresser of claim 1, wherein the highest protruding tip of each of the plurality of superabrasive particles align along the designated profile with a tip variation of from about 10 microns to about 50 microns.

14. The dresser of claim 1, wherein the highest protruding tip of each of the plurality of superabrasive particles align along the designated profile with a tip variation of from about 20 microns to about 40 microns.

15. The dresser of claim 1, wherein the highest protruding tip of each of the plurality of superabrasive particles align along the designated profile with a tip variation of less than about 20 microns.

16. The dresser of claim 1, wherein the protrusions of the plurality of superabrasive particles produce cutting depths of less than about 20 microns when used to abrade a CMP pad.

17. The dresser of claim 1, wherein the protrusions of the plurality of superabrasive particles produce cutting depths of from about 1 micron to about 20 microns when used to abrade a CMP pad.

18. The dresser of claim 1, wherein the protrusions of the plurality of superabrasive particles produce cutting depths of from about 10 microns to about 20 microns when used to abrade a CMP pad.

19. The dresser of claim 1, wherein the designated profile includes a configuration selected from the group consisting of a plane, a slope, a curved shape, a dome shape, and combinations thereof.

20. The dresser of claim 1, wherein the plurality of superabrasive particles is arranged across the support substrate in a predetermined pattern.

21. The dresser of claim 20, wherein the predetermined pattern includes an even distribution of the plurality of superabrasive particles spaced at a distance of from about 100 microns to about 800 microns.

* * * * *